US006108844A

United States Patent [19]

Kraft et al.

[11] Patent Number: 6,108,844

[45] Date of Patent: Aug. 29, 2000

[54] AIR MATTRESS FOR A SLEEPER SOFA

[75] Inventors: Dieter H. Kraft, Alpharetta, Ga.; Darren M. McKim, Plymouth, Minn.; Troy W. Larson; James A. Flanegan, both of Alpharetta, Ga.

[73] Assignee: SleepTec, Inc., Alpharetta, Ga.

[21] Appl. No.: 09/266,392

[22] Filed: Mar. 11, 1999

Related U.S. Application Data

[60] Provisional application No. 60/077,498, Mar. 11, 1998.

[51] Int. Cl.[7] ..... A47C 27/10

[52] U.S. Cl. ..... 5/732; 5/710; 5/739; 5/713

[58] Field of Search ..... 5/17, 18.1, 21, 5/12.1, 28, 30, 35, 54, 691, 710, 713, 722, 723, 739, 496, 497, 499, 927, 732

[56] References Cited

U.S. PATENT DOCUMENTS

| | | | |
|---|---|---|---|
| 8,800 | 3/1852 | Hammitt . | |
| 140,306 | 6/1873 | Rand et al. . | |
| D. 159,995 | 9/1950 | Limpus | D5/4 |
| D. 192,679 | 5/1962 | Kamp | D5/4 |
| D. 329,146 | 9/1992 | Neal | D6/336 |
| 1,536,888 | 5/1925 | Kwiatkowski et al. . | |
| 1,576,211 | 3/1926 | O'Kane | 5/732 X |
| 2,217,426 | 10/1940 | Zareko | 155/46 |
| 2,549,597 | 4/1951 | Harris et al. | 5/732 X |
| 2,568,366 | 9/1951 | Rosen | 5/18 |
| 2,671,228 | 3/1954 | Maria | 5/41 |
| 2,696,872 | 12/1954 | Kurland et al. | 5/497 |
| 2,703,600 | 3/1955 | Harper | 155/114 |
| 2,784,419 | 3/1957 | Cimon | 5/18 |
| 3,019,454 | 2/1962 | Luca | 5/17 |
| 3,064,276 | 11/1962 | Newsom, III | 5/17 |
| 3,147,496 | 9/1964 | Mendoza | 5/348 |
| 3,792,501 | 2/1974 | Kery | 5/348 R |
| 4,067,073 | 1/1978 | Komarov | 5/13 |
| 4,153,958 | 5/1979 | Paulik | 5/12 R |
| 4,169,295 | 10/1979 | Darling | 5/450 |
| 4,204,287 | 5/1980 | Lane et al. | 5/18 R |
| 4,442,556 | 4/1984 | Craigie | 5/13 |
| 4,480,344 | 11/1984 | Padovan | 5/48 |
| 4,547,919 | 10/1985 | Wang | 5/455 |
| 4,586,206 | 5/1986 | Singer | 5/18 R |
| 4,694,515 | 9/1987 | Rogers, Jr. | 5/13 |
| 4,712,261 | 12/1987 | Castro | 5/499 |
| 4,768,252 | 9/1988 | Ross | 5/497 |
| 4,890,344 | 1/1990 | Walker | 5/453 |
| 4,905,332 | 3/1990 | Wang | 5/455 |
| 4,964,183 | 10/1990 | LaForce, Jr. | 5/421 |
| 4,977,633 | 12/1990 | Chaffee | 5/453 |
| 5,101,524 | 4/1992 | Brandschain | 5/17 |
| 5,101,823 | 4/1992 | Smith | 128/369 |
| 5,604,945 | 2/1997 | Fisher et al. | 5/706 |
| 5,740,573 | 4/1998 | Boyd | 5/711 |

*Primary Examiner*—Michael F. Trettel
*Attorney, Agent, or Firm*—Needle & Rosenberg, P.C.

[57] ABSTRACT

A sleeper sofa incorporating an air mattress including a telescoping mattress frame for supporting a mattress support subassembly consisting of hinge panels. The hinges used to connect the panels limit the angular range of motion of adjacent panels to plus or minus 90° from a coplanar arrangement. The "panel" that defines the seating surface on which seat cushions rest when the sofa is in the seating position may be supported in the seating position by a pair of side rails that lack significant structure in the seating plane. This "panel" may also include a set of sinuous springs clad in padding similar to the seat-cushion support surface of a conventional non-sleeper sofa. The air mattress used in the sleeper sofa can be a multi-chamber design in which the outer edges of the mattress are inflated to a higher pressure to prevent the user from rolling off the edge of the mattress. The mattress may also include a centrally located longitudinal divider portion, inflated to a higher pressure, between individually pressure controlled sleeping portions to prevent one user from rolling from a high pressure sleeping area to the adjacent sleeping area when the adjacent area is at a lower pressure than the high pressure sleeping area. The mattress may also include a cover with internally attached elastomeric straps used to assist mattress deflation in specific areas of the mattress, like the foot end, for example.

15 Claims, 19 Drawing Sheets

AIR MATTRESS FOR A SLEEPER SOFA

This document claims priority to U.S. Provisional Patent Application Serial No. 60/077,498 filed Mar. 11, 1998, now expired.

BACKGROUND OF THE INVENTION

A. Field of the Invention

The applicants' invention relates to a sleeper sofa using an air mattress instead of a conventional spring mattress and various assemblies and subassemblies of the sofa.

B. Background

More and more people are replacing their conventional, spring mattresses with air mattresses. Increased public acceptance of air mattresses is due, in part, to their superior sleeping comfort. Conventional air mattresses have a flexible body enclosing at least one air chamber that is inflatable using an air pump. Once inflated, the air chamber is made pressure-tight by closing a valve within a portal in the chamber. Such an inflated mattress typically has two opposed, planar surfaces, and the user sleeps on the top surface. To deflate the mattress, the user releases air from the chamber to collapse the mattress so that it may be folded for storage. Typically, the user may incrementally deflate the mattress to adjust the firmness of the mattress for comfort.

In contrast to a comfortable air mattress, the most reviled sleeping surface is a pull-out sleeper sofa, which is in widespread use. Commercially available sleeper sofas have a mattress folded within a sleeper sofa subassembly when the sleeper sofa is in the collapsed position. Although lacking in comfort, convertible sleeper sofa arrangements are popular because they provide a bed for overnight guests and, when not in use, fold out of the way to provide, normally with the aid of cushions, a seating surface. They do two jobs at once.

Conventional sleeper sofas are uncomfortable because of size constraints and the poor support provided by typical mattress support subassemblies. Because the mattress in a conventional sleeper sofa must fold into the sofa, it must be substantially thinner, and thus less comfortable, than a full-size bed mattress. The mattress may not be as well padded as a conventional bed mattress and the steel springs may not provide support as firm and even as a conventional bed mattress. This thin, unsupportive, lumpy sleeper sofa mattress is made even less comfortable by a flimsy and uneven support subassembly. Typical support subassemblies include a wire mesh slung across an open frame (or a spring-supported polymer weave called a trampoline) and hinge bars extending just below the wire mesh or trampoline. As most who have slept on a conventional sleeper sofa know, they are uncomfortable because the user feels a thin, lumpy flaccid mattress poorly supported on a wire mesh that is draped over several hinge bars and a metal mattress support structure, all of which are felt through the mattress.

Commercially available sleeper sofas cannot accommodate a full-thickness mattress, but they are nevertheless bulky and heavy because of the complex folding mattress frame. To extend the mattress frame from the sofa position to the open bed position often requires physical strength beyond some people's abilities because of advanced age or health infirmities. People who can fold and unfold the frame often pinch their fingers and skin their shins. Thus, a need exists in the art for an improved sleeper sofa that is at least as comfortable as a conventional bed and easy to extend and retract.

SUMMARY OF THE INVENTION

The sleeper sofa and subassemblies according defining the applicants' invention drastically improve upon the utility and comfort of conventional sleeper sofas. The applicants' sleeper sofa combines the comfort of an air mattress with the practical benefits of a sleeper sofa, but with a mattress frame that is much easier to deploy from and stow into the sofa. In one aspect of the applicants' invention, they have designed a mattress frame that accommodates an air mattress as the sleeping surface by, for example, telescopically expanding and retracting (instead of folding) the frame out of and into the sofa body. Because the mattress frame moves telescopically, the user need not lift any part of the mattress frame to deploy it from or stow it into the sofa. To provide enough support for mattress 40, preferably, a series of solid supports (instead of the wire mesh or trampoline used in conventional sleeper sofas) sits atop the applicants' mattress frame. The user may automatically inflate the mattress with a blower capable of incrementally adjusting the pressure within the mattress, and thus its firmness and comfort. To speed the deflation of the mattress, the user preferably uses a reversible motor. The pneumatic equipment may be packaged as a separate portable unit, with a battery power source, or built into the sleeper sofa.

Many different embodiments of the applicants' sleeper sofa and its subassemblies are described in this document. Two general types of sleeper assemblies are described, a folded support or box style and a serpentine style, with exemplary variations of each type. To ease its installation into a nearly conventional sofa frame, the box style sleeper assembly can be manufactured as a "drop-in" module. The applicants' sleeper sofa may also include an automated mechanism to extend and retract the mattress frame, for example, a pulley system or a push-pull chain system. Another aspect of the applicants' invention includes a "ringer," which deflates mattress 40 as it is retracted into the sofa body when the mattress frame is retracted.

The applicants' invention also includes other aspects, such as a retro-fit mattress system that the owner of a conventional sleeper sofa to install an air mattress into the sofa with its trampoline, wire-mesh frame. Still another aspect of the applicants' invention is an inflatable mattress cover for a conventional mattress, in which the cover revitalizes and changes the old mattress into a comfortable sleeping surface, regardless of the condition of its mattress springs. The applicants have further improved air mattresses by providing a separately inflated chamber located along at least a portion of the outer edge of the mattress body which minimizes the "roll off" nature of the edge of conventional air mattresses while allowing the mattress to be folded easily into a sleeper sofa.

The foregoing general description and the following detailed description of the applicants' invention are exemplary and explanatory only and do not restrict the claims directed to the invention. The accompanying drawings, which are incorporated in and constitute a part of this specification, illustrate various embodiments of the invention and together with the description, serve to explain the principles of the invention.

BRIEF DESCRIPTION OF THE DRAWINGS

FIG. 1D is a perspective view of the sleeper sofa shown in FIG. 1A, but with the seat cushions removed to expose the fully unfolded mattress on an extended, five-panel embodiment of a mattress support subassembly.

FIG. 1E is a perspective view of the sleeper sofa shown in FIG. 1A, in a sleeping position with the seat cushions removed to expose the fully unfolded and inflated mattress supported on an extended, five-panel embodiment of a mattress support subassembly.

DETAILED DESCRIPTION OF THE INVENTION

The applicants refer below in detail to the exemplary embodiments of the invention, examples of which are illustrated in the accompanying drawings. Numerous modifications and variations to the invention will be apparent to those skilled in the art. Wherever possible, the same reference numbers will be used throughout the drawings to refer to the same or like parts. As used in the specification and in the claims, "a" can mean one or more, depending upon the context in which it is used.

The applicants' sleeper sofa has an attractive external appearance, similar to a conventional sofa. Although not apparent when in the seating position, the applicants' sofa also includes a mattress frame that telescopes into and out of the sofa body rather than folding into and out of the sofa body as is in conventional sleeper sofas. In some of the embodiments of the applicants' sleeper sofa described below, the mattress support subassembly also slides into and out of the sofa body, while in others, the mattress support subassembly folds atop the telescoping mattress frame.

Figure 1A:
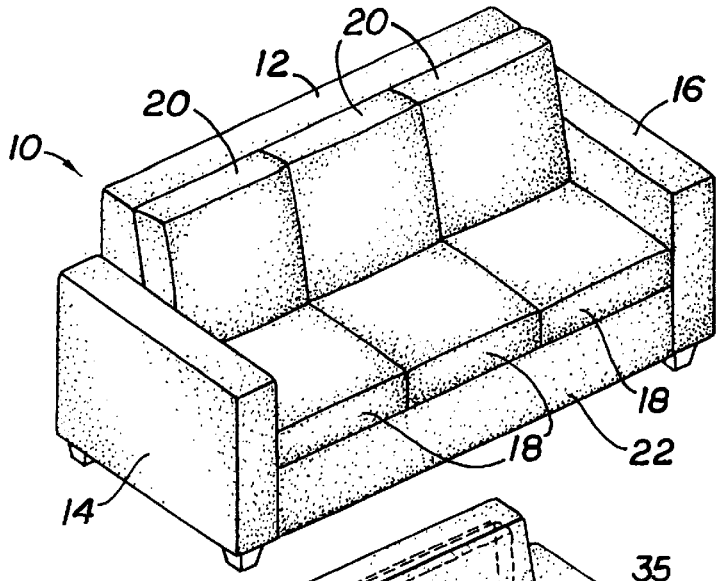
FIG. 1A is a perspective view of one embodiment of a sleeper sofa according to the applicants' invention shown in a sofa mode.

FIGS. 1A–E generally depict one embodiment of a sleeper sofa according to the applicants' invention. The sleeper sofa may have a conventional sofa frame including opposed armrests, a backrest or back portion, and a cavity for receiving mattress 40 or mattress support. The seat and backrest cushions are used when the sleeper sofa is used as a sofa (when the mattress frame and support subassembly are stowed in the sofa) to provide a comfortable seating surface designed with a unique spring surface as illustrated in FIG. 1A. The seat cushions are removable to permit the sleeper sofa to be moved between the retracted or seating position and the seating or sleeping position. The removed seat cushions are stored in a convenient location until the mattress frame and support subassembly are returned to the seating position. The sofa 10 is depicted in FIGS. 1A–1E in a sequence illustrating the manner in which sleeper assembly 35 of sofa 10 is moved from a seating position (FIGS. 1A and 1B) to a sleeping position (FIGS. 1D and 1E).

Figure 1B:
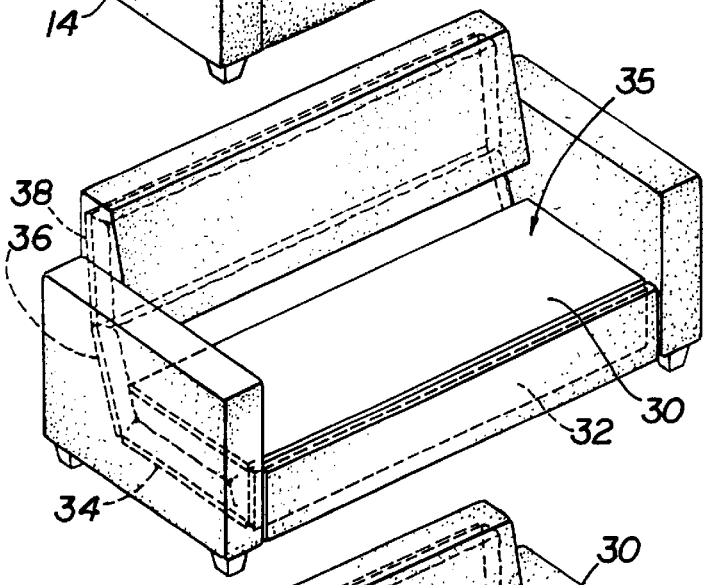
FIG. 1B is a perspective view of the sleeper sofa shown in FIG. 1A, but with the seat cushions removed to expose the fully retracted bed mechanism.
Figure 1C:
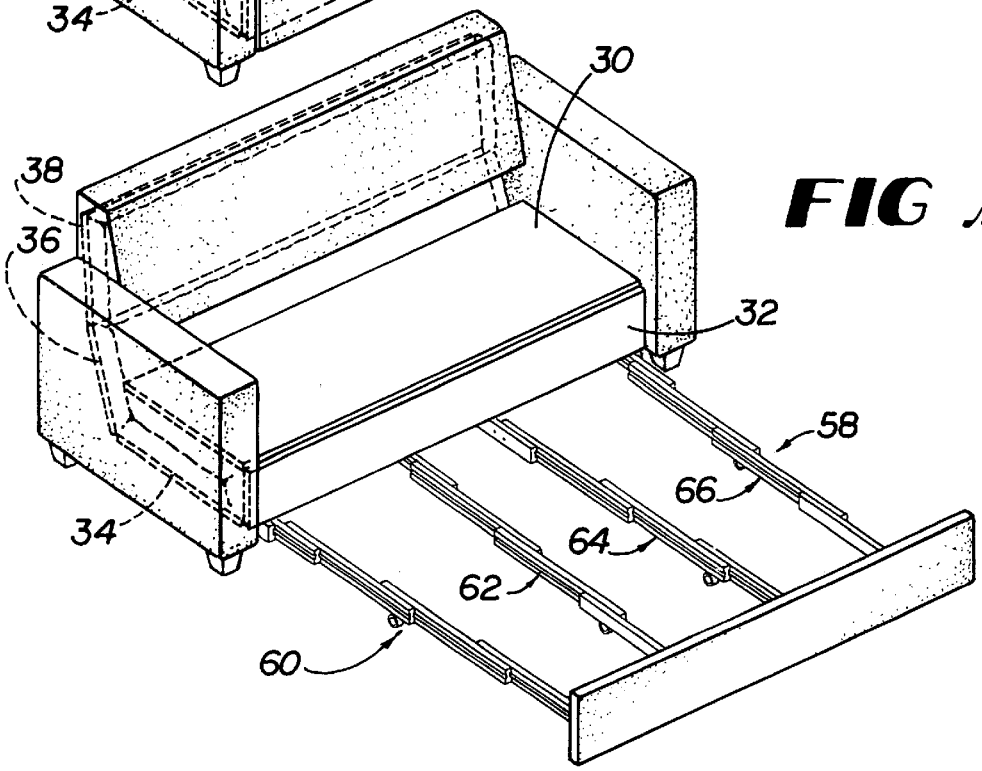
FIG. 1C is a perspective view of the sleeper sofa shown in FIG. 1A, but with the seat cushions removed to expose the fully folded mattress and support system and a fully expanded mattress frame.
Figure 4D:
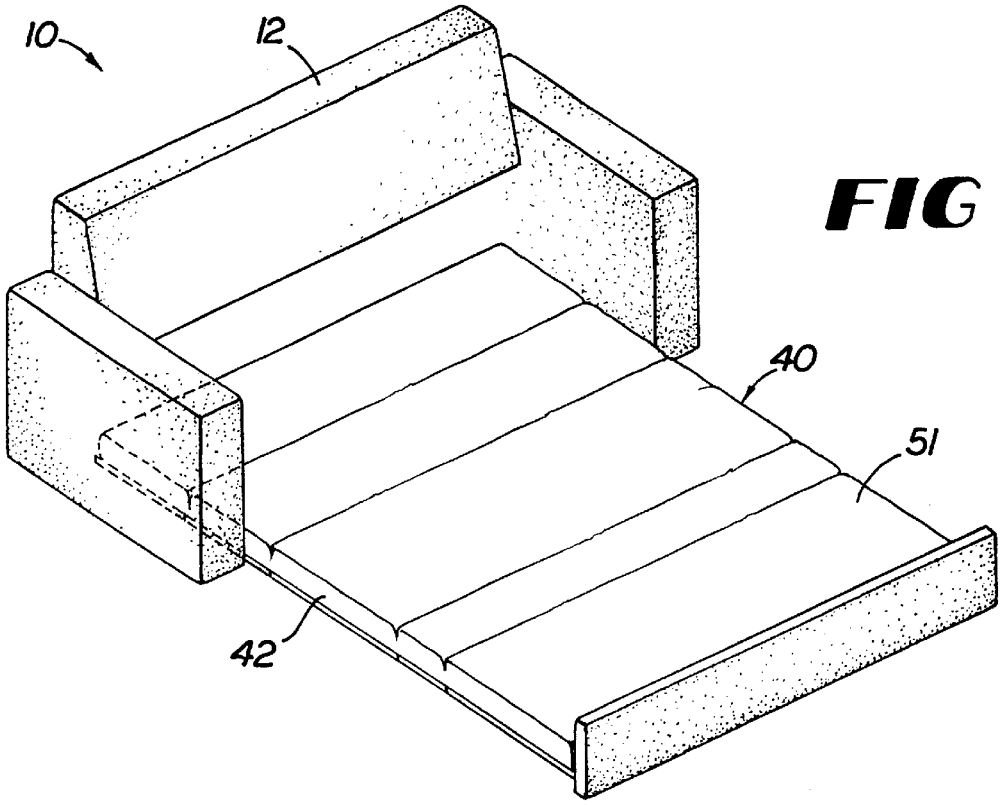
FIG. 4A is a cross-sectional side view of the embodiment of a five-panel, mattress support subassembly, but in the retracted seating position.
FIG. 4B is a perspective view of a hinge assembly used to connect the support panels shown in FIGS. 4A.
Figure 4E:
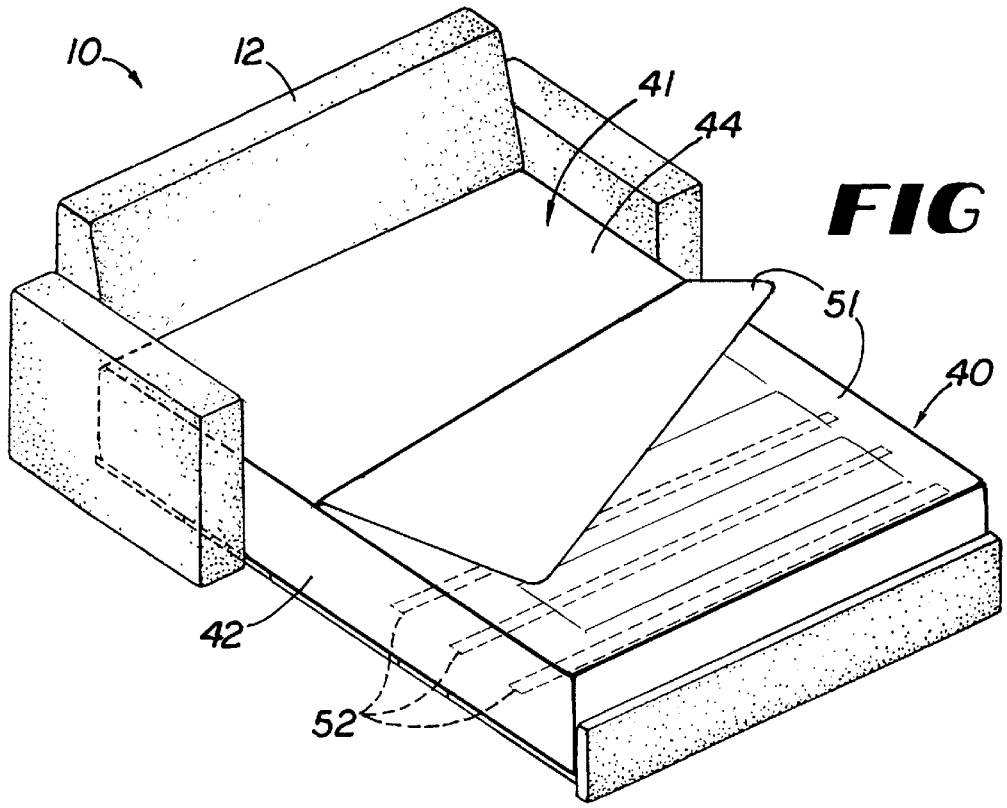

FIG. 1A is a perspective view of one embodiment of sleeper sofa 10 shown in a seating position with cushions 18 on sofa 10. FIG. 1B is a perspective view of sleeper sofa 10, but with the seat cushions 18 removed to expose the fully retracted sleeper assembly 35 in the seating position. FIG. 1C is a perspective view of the sleeper sofa 10, but with the seat cushions 18 removed to expose the fully folded mattress and mattress support system comprising panels 30, 32 and 34. FIG. 1C also depicts mattress frame 58 in a fully extended sleeping position. FIG. 1D is a perspective view of the sleeper sofa 10 but with the seat cushions 18 removed to expose the fully unfolded mattress on an extended, five-panel embodiment of a mattress support subassembly. FIG. 1E is a perspective view of the sleeper sofa 10, in a sleeping position with seat cushions 18 removed to expose the fully unfolded and inflated mattress 40 supported on an extended, five-panel embodiment of a mattress support subassembly. Mattress cover 51 is shown pulled back to reveal mattress body 41 and top 44. Also shown in broken lines are straps 52, which assist in deflating mattress body 41 from the foot end of mattress 40 first by pulling opposite portions of sidewall 42 toward each other.

A. Folded-Support Embodiment

The first embodiment of the sleeper sofa of the applicants' invention is the folded-support or box system, for which several variations are described including a five-panel version, a four-panel version, and a sideways sleeper design.

1. Five-Panel Version

Figure 4A:
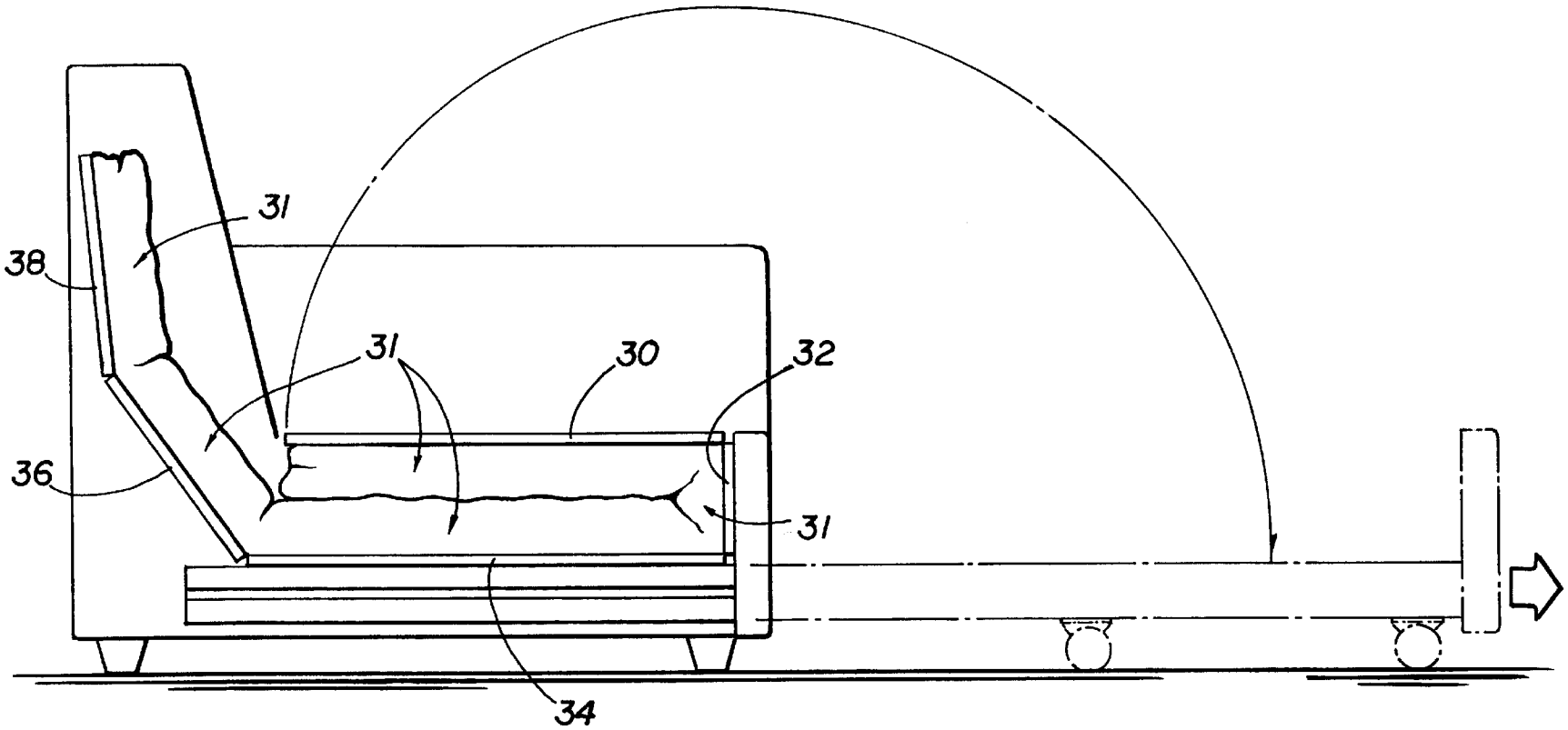
Figure 4B:
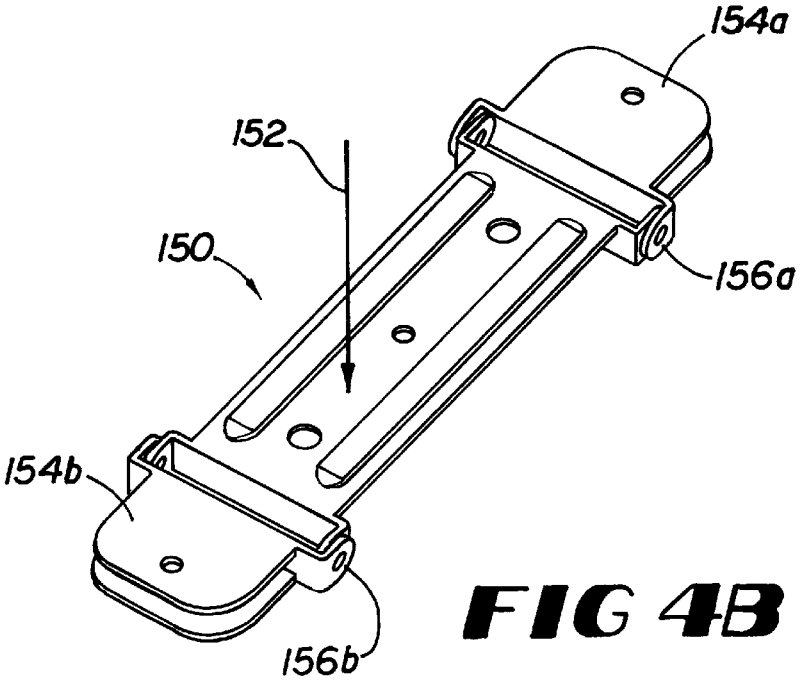

FIG. 4A illustrates the five-panel version of the folded-support embodiment in the seating position for use as a sofa. The foldable mattress support subassembly includes five pivotally connected rectangular panels 30, 32, 34, 36, and 38 (collectively support panels 31) that form a horizontal mattress support structure when unfolded. The support panels 30, 32, and 34 are preferably connected with two of hinges 150 (see FIG. 4B). The support panels 31 may be formed of wood such as plywood, plastic or other polymers, metal, or any other suitable material. The support panels 31 as shown define unbroken surfaces. However support panels 31 may also be structurally engineered panels that do not define unbroken surfaces.

Hinge 150 includes a center portion 152 to which two flanges 154*a* and 154*b* are hinged around pivot axes 156*a* and 156*b* respectively. Center portion 152 of hinge 150 spans the entire width of panel 32 and is attached to panel 32 (e.g., with screws). Panels 30 and 34 are attached to flanges 154*a* and 154*b*. Hinges 150 limit the range of angular movement of panel 34 to panel 32 and panel 32 to panel 30 to plus or minus about 90° so that panels 30, 32 and 34 may be folded into a U shape with panels 30 and 34 parallel, but not past parallel.

Figure 8:
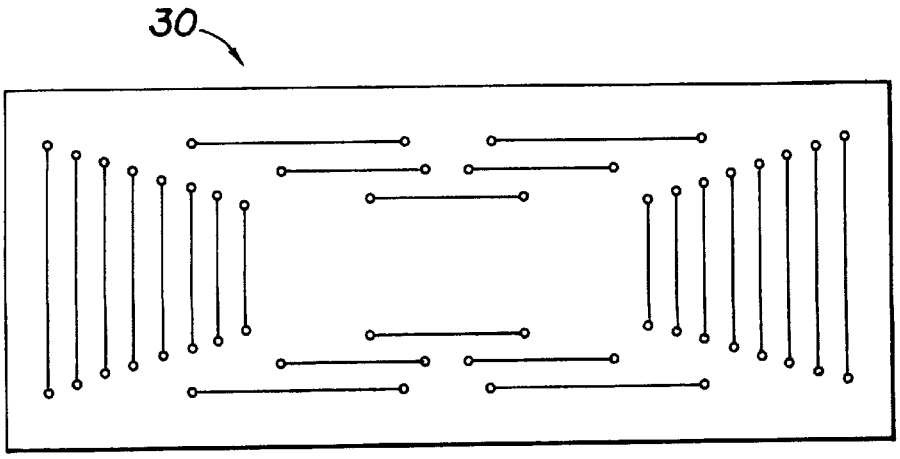
FIG. 8 is a plan view of a panel used as a seating suspension member to support seat cushions when a sleeper sofa according to the applicants' invention is in a seating position.

Panel 34 remains horizontally disposed in the seating and sleeping positions. In contrast, panels 30, 32, 36, and 38 of the five-panel version change orientations relative to the horizontal panel 34 as they are moved from the seating position to the sleeping position and back to the seating position. As shown in FIG. 4A, the panels 36 and 38 are in an upstanding orientation relative to panel 34. When in the seating position, panel 32 is also upstanding, specifically oriented perpendicular to panel 34, and panel 30 is substantially parallel to panel 34. As shown in FIG. 4A, with support panels 31 in the seating position, one side of panel 30 faces down toward panel 34 and contacts a portion of air mattress 40 and the opposite side of panel 30 faces upward and supports seat cushions 18 (not shown) of sofa 10. As shown in FIG. 8, panel 30 may have a number of apertures through it so that panel 30 flexes more than a solid panel to provide a more resilient support for cushions 18.

To move support panels 31 from the seating position shown in FIG. 4A to the sleeping position, seat cushions 18 are first removed and footboard 22 is pulled away from back 12. Footboard 22 is connected to a plurality of groups of braces 60, 62, 64, and 66 that telescopically extend to provide a mattress frame 58 on which support panels 31 are disposed when they are in the sleeping position. Each of the groups of braces 60, 62, 64, and 66 comprises a plurality of individual braces connected to each other so that they slide in the longitudinal direction defined by the group of braces.

Figure 2:
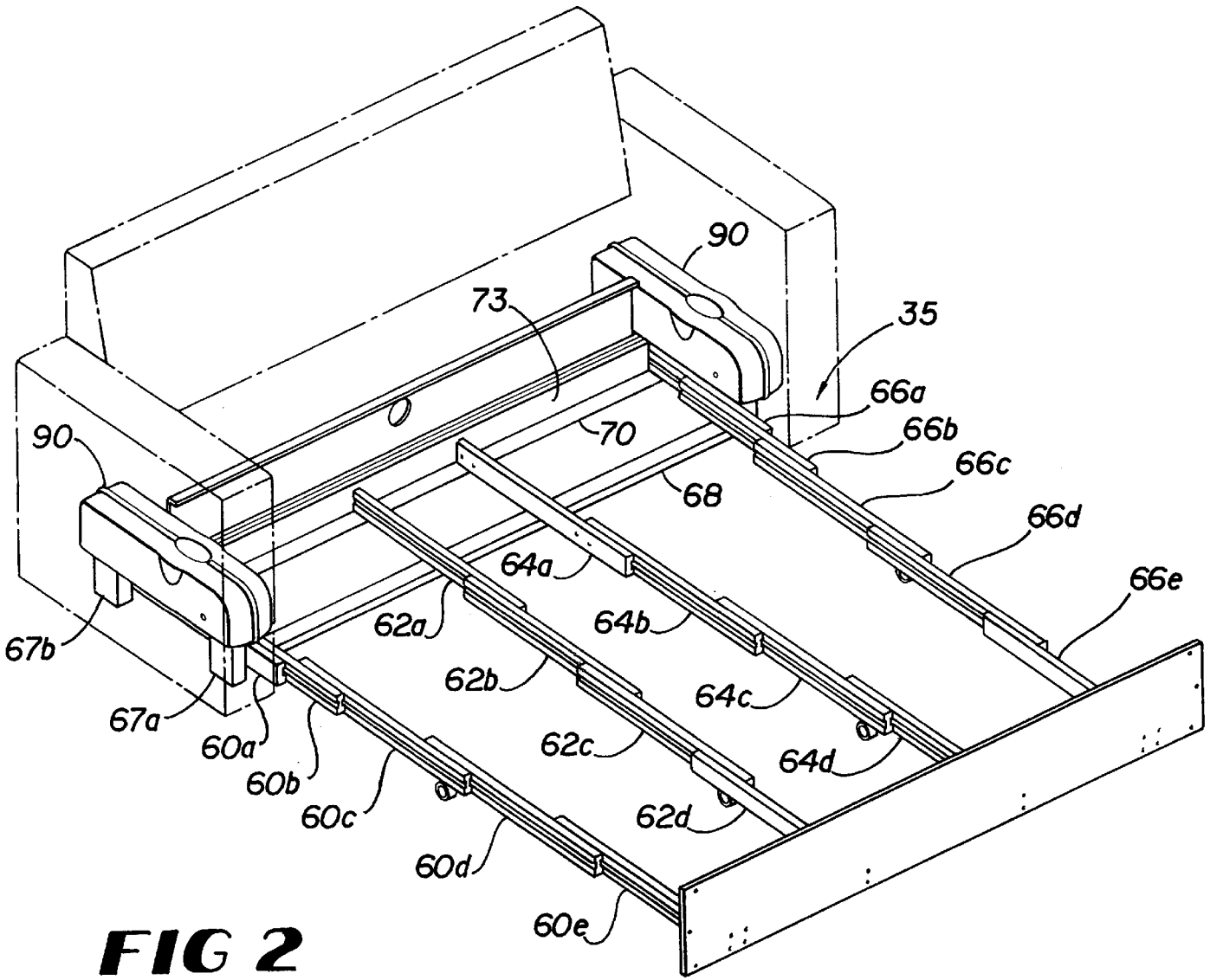
FIG. 2 is a perspective view of a mattress frame and a pneumatic system according to the invention as it would be positioned within a sleeper sofa.

FIG. 2 illustrates groups 60, 62, 64, and 66 of braces and footboard 22 in the sleeping position. Groups 60 and 66 include five individual braces and function substantially the same way. From the back 12 of sofa 10 to footboard 22, the braces of group 60 include braces 60*a*, 60*b*, 60*c*, 60*d*, and 60*e*. Similarly, the braces of group 66 include braces 66*a*, 66*b*, 66*c*, 66*d*, and 66*e*. Brace 60*a* is spatially fixed relative to the frame of the sleeper assembly 35, specifically to transverse rails 68 and 70 in the illustrated embodiment, and is thus spatially fixed relative to sofa 10. As footboard 22 is pulled away from back 12, braces 60*a*, 60*b*, 60*c*, 60*d*, and 60*e* move relative to each other so that the group 60 lengthens. Braces 60*a*, 60*b*, 60*c*, 60*d*, and 60*e* may be slidably connected in a number of ways. Any manner of slidably connecting braces 60*a*, 60*b*, 60*c*, 60*d*, and 60*e* is acceptable as long as the braces slide relative to each other along their respective longitudinal axes and for a limited range of travel.

Groups 62 and 64 include four individual braces and function substantially the same way. From the back 12 of sofa 10 to footboard 22, the braces of group 62 include braces 62*a*, 62*b*, 62*c*, and 62*d*. Similarly, the braces of group 64 include braces 64*a*, 64*b*, 64*c*, and 64*d*. The braces can be formed of wood, plastic or other polymers, or any other suitable material.

To illustrate the sliding connection between adjacent braces in groups 60, 62, 64, and 66 of brace, brace 60*a* has a groove and brace 60*b* has a complementary protrusion that slides within the groove in brace 60*a*. The protrusion on brace 60*b* slides along the groove as brace 60*b* is longitudinally extended relative to brace 60*a* so that braces 60*a* and 60*b* maintain their relative lateral positions. When brace 60*b* is fully extended relative to brace 60*a*, the protrusion on brace 60*b* contacts a stop in the groove in brace 60*a* to prevent additional longitudinal extension of brace 60*b*. Each pair of adjacent braces in all the groups 60, 62, 64, and 66 of braces is similarly connected to each other. For each pair of adjacent braces, the stop in the proximal brace limits the maximum extension of the distal brace to limit the extended length of the pair. Thus, a maximum extended length for each group 60, 62, 64, and 66 of braces is defined that establishes the correct extended length of mattress frame 58 for properly supporting air mattress 40.

A footboard attachment bracket (not shown) is attached to the distal end of each of braces 60*e*, 62*d*, 64*d*, and 66*e*. The upholstered footboard 22 is attached to the footboard bracket. Thus, the user manually moving the mattress frame 58 to the sleeping position pulls footboard 22 away from back 12 of sofa 10, which correspondingly pulls distal-most braces 60*e*, 62*d*, 64*d*, and 66*e* attached to footboard 22. As the user continues to extend mattress frame 58, groups 60, 62, 64, and 66 of braces until they are fully extended. Once fully extended, the user preferably pulls the entire mattress frame 58 a short distance farther from back 12 until mattress frame 58 is in the sleeping position. Such an action creates a gap between the head end of mattress frame 58 and back 12 of sofa 10. Essentially, the proximal ends of braces 62*a* and 64*a* are attached to headboard 73 (FIG. 2), which can slide relative to the structure supporting arms 14 and 16. But braces 60*a* and 66*a* are attached to part of the structure of arms 14 and 16 respectively. Thus, when groups 62 and 64 of braces are fully extended and the user pulls footboard even farther away from back 12, groups of braces 63 and 64 pull headboard 73 away from back 12 as groups 60 and 66 of braces extend further to their fully extended position. As discussed below, mattress frame 58 may be fully extended and retracted between its sleeping and seating positions in an automated manner.

Mattress frame 58 is supported on the floor by, for example a series of casters or wheels, which can be attached to any number of braces. In the embodiment shown in FIG. 2, casters are connected to the bottoms of braces 60*c*, 60*e*, 62*c*, 64*c*, 66*c*, and 66*e*, which support the weight placed on the extended groups 60, 62, 64, and 66 of braces. Foundation blocks 67 also position and support braces 60*a* and 66*a* and thus the proximal end of groups 60 and 66 of braces.

As one skilled in the art will appreciate, more or less than four groups of braces can be used, depending on the desired design. Likewise, the number of braces in each group of braces can be changed as desired. Factors for determining the number and type of braces used include the length of the mattress support and air mattress to be disposed on the surface extending between the footboard and the back portion of the sofa, the weight loading, the strength of the braces, the materials used to form the braces, and the maximum desired weight of the sleeper sofa itself. One skilled in the art will also appreciate that the arrangement of protrusions and grooves can be reversed from the discussion above and that complementary groves and protrusions is not the only way of slidably connecting the braces.

Once the groups 60, 62, 64, and 66 of braces are in the sleeping position as shown in FIG. 2, the mattress support subassembly can be disposed on mattress frame 58. As shown in FIG. 4A, the user can first extend panels 30 and 32 so that they are parallel to panel 34 by unfolding them and laying them atop mattress frame 58. Once panels 30, 32, and 34 are unfolded, then the person can pull panel 30 toward the footboard, which causes panels 36 an 38 slide down out of back 12.

Panels 36 and 38 can slide into and out of back 12 of sofa 10. In the embodiment shown in FIG. 4A, panel 38 (which is disposed at the highest position within back 12 of sofa 10 when sleeper assembly 35 is in the seating position) has wheels or castors (not shown) attached to its proximal end. The wheels engage a curved track or surface which guides panels 36 and 38 into and out of back 12 of sofa 10. Additional wheels can also be placed at different locations on the underside of panels 36 and 38 to ensure that the panels move freely between the sleeping and seating positions. The wheels contact and ride along a surface (not shown) positioned at the rear interior section of back 12. This surface is oriented to allow panels 36 and 38 to traverse smoothly into and out of back 12 without binding against the body of sofa 10.

While being extended, panels 36 and 38 move downwardly and out of back 12. Panels 36 and 38 follow panel 34 as it is pulled away from back 12. As sleeper assembly 35 is moved from the seating to the sleeping position, the obtuse angle between panels 34 and 36 increases to about 180° until panels 34 and 36 form a substantially contiguous planar surface. Continued pulling of panel 30 toward footboard 22 causes panels 36 and 38 to move down and out of back 12 so that all five panels form a substantially flat surface on which air mattress 40 is disposed. That is, as panel 30 is pulled away from back 12 of sofa 10, panels 32 and 34 follow and panels 36 and 38 are withdrawn from back 12 of sofa 10. The sleeping position is attained when panel 30 reaches footboard 22. At this point, the mattress frame and support subassembly provides a solid surface for supporting air mattress 40.

Instead of wheels on the undersides of panels 36 and 38 that ride along a surface within the interior of back 12, other means (not shown) may enable panels 36 and 38 to move between the seating and sleeping seating positions. For example, arcuate or curved tracks or channels placed within the interior and adjacent each side of back 12 may replace the surface within the interior of back 12. Complementary guides mounted on panels 36 and 38 are attached to the lateral edges of panels 36 and 38. The guides have a low friction interface with the channel slide within the channel as panels 36 and 38 are moved between the sleeping and the seating positions. The guides, for example, can be wheels or dowels.

In order to return sleeper assembly 35 back to the seating position, mattress 40 is preferably, at least partially deflated. Once panels 30 and 32 are folded to the seating positions discussed above and as shown in FIG. 4A, all or most of braces 60*d* and 60*e*, 62*c* and 62*d*, 64*c* and 64*d*, and 66*e* and 66*d* no longer support mattress 40. Thus, footboard 22 is easily pushed to be adjacent panel 32, which is oriented vertically. As the user continues to push footboard 22 toward back 12 of sofa 10, panels 36 and 38 are correspondingly pushed to move upwardly into back 12 of sofa 10 until reaching sleeper 35 is in the seating position, as shown in FIG. 4A.

Figure 25:
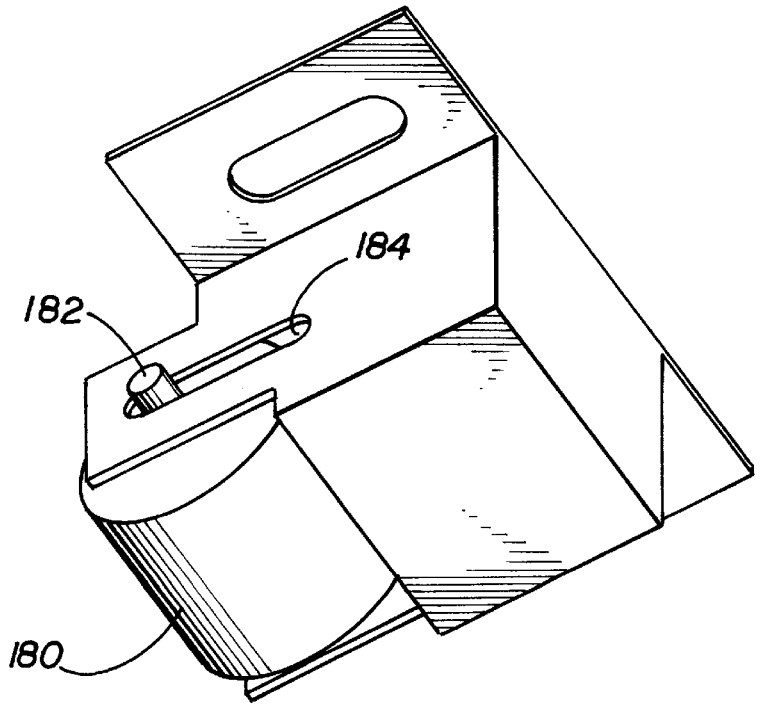
FIG. 25 is a perspective view of one half of a latch mechanism used to secure the footboard of the sofa to the sofa body.

To secure footboard 22 in the seating position, a latch mechanism with complementary components is connected to the distal side of footboard 22 and the underside of proximal ends of arms 14 and 16. The portion of the latch mechanism attached to footboard 22 is, for example, a flange attached near one lateral end of footboard 22 and extending toward back 12 with an upward facing ridge parallel to footboard 22 and near the rearmost edge of the flange (not shown). The complementary portion of the latch mechanism attached to arms 14 and 16 and is, for example, a wheel 180 mounted on an axle 182 that slides in a downward extending channel 184 and is biased downward with a spring (see FIG. 25). When footboard 22 is pushed toward sofa 10, the ridges on the flanges cam the wheels 180 upward against the force of the springs. As footboard 22 contacts sofa 10, the springs force the wheels 180 down the side of the ridge near footboard 22 and secure footboard 22 against sofa 10. This latch mechanism ensures that mattress frame 58 does not inadvertently extend when sofa 10 is in the seating position. Footboard 22 provides a finished appearance to the front of sofa 10 and prevents damage to the interior of sofa 10 when sofa 10 is in the seating position. When footboard 22 is latched against sofa 10 in the seating position, seat cushions 18 may be placed onto panel 34 so that sofa 10 may be used as a sofa.

2. Four-Panel Version

As one skilled in the art will appreciate, it may be difficult to push manually footboard 22 into the seating position when moving panels 36 and 38 of the five-panel version into back 12 of sofa 10. The forces opposing moving panels 36 and 38 of the five-panel version upwardly into sofa 10 include gravity and the frictional resistance of pushing against groups 60, 62, 64, and 66 of braces. Accordingly, the five-panel version of the folded-support mattress embodiment of FIG. 4A may be difficult for someone in poor health to operate easily. One option is to use an automated retraction and extension system to move support panels 31 between the sleeping and seating positions, which is discussed below. Another option is to use the four-panel version of the folded support embodiment.

As shown in FIG. 3B, the four-panel version of the folded-support embodiment has only four support panels, panels 30, 32, 34, and 36 (collectively support panels 31). Panels 30, 32, and 34 fold into a sideways "U" shape when in the seating position (similar to the configuration of panels 30, 32, and 34 of the five-panel version). When in the sleeping position, support panels 31 of the four-panel version form a planar surface. However, unlike the five-panel version, the rearmost panel 34 in the "U" of the four-panel version is spatially fixed relative to back 12 of sofa 10. Thus, panel 34 does not slide along mattress frame 58 when moved between the seating and sleeping positions, as occurs in the five-panel version. Additionally, panel 37, not connected to the panels forming the U, is fixedly attached to mattress frame 58 adjacent footboard 22.

Figure 3:
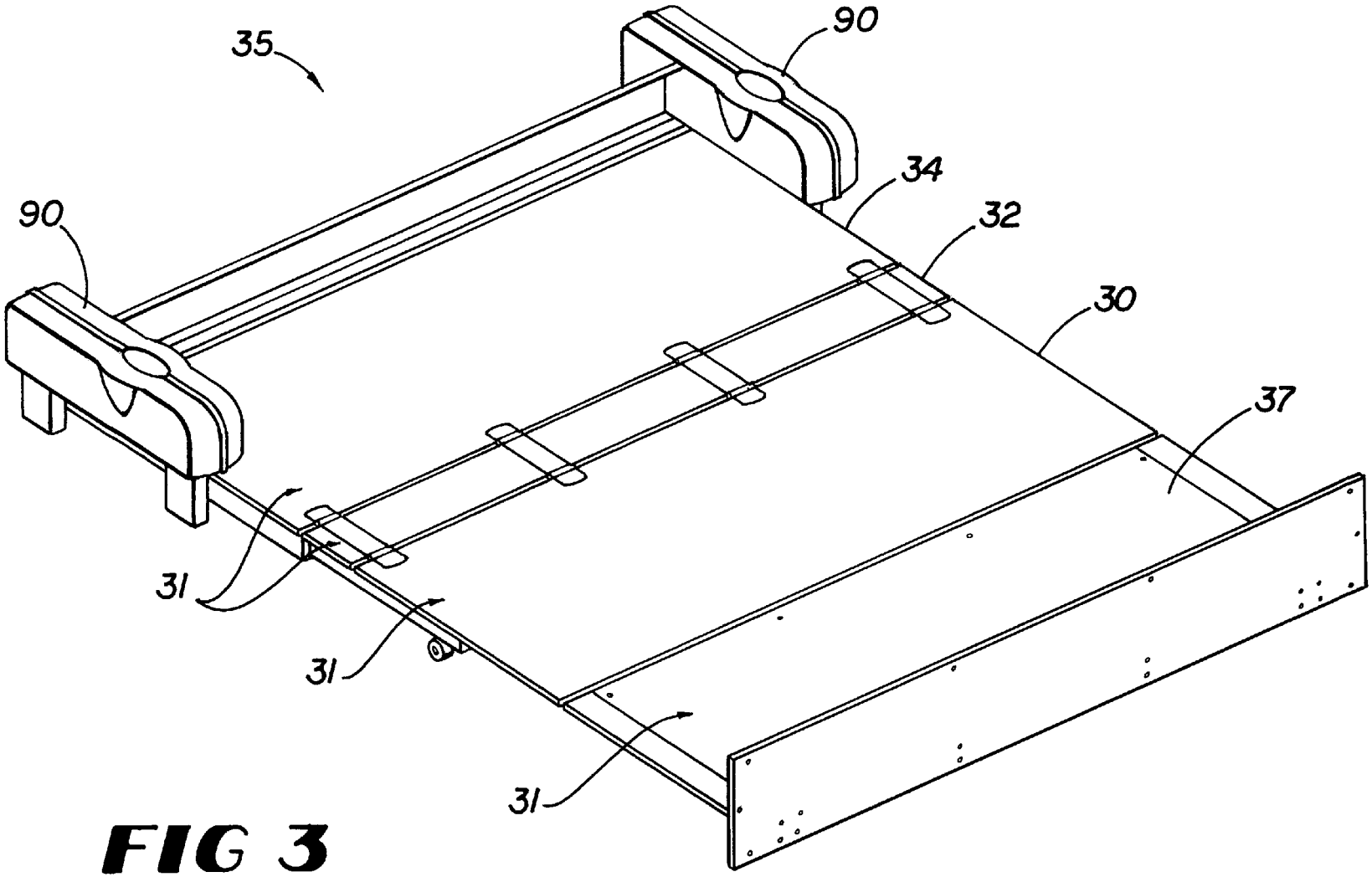
FIG. 3 is a perspective view of a sleeper assembly and a pneumatic system with a four-panel embodiment of a mattress support subassembly shown in a sleeping position on the mattress frame.

Panels 30, 32, and 34 are attached to each other in a unique hinging arrangement so that a single panels 30, 32, and 34 is created when the U is unfolded to the sleeping position. When sleeper assembly 35 is in the seating position, panels 30 and 32 are folded so that panel 30 is located above panel 34 and panel 37 is stowed under panel 34. When moving sleeper assembly 35 to the sleeping position from the seating position, footboard 22 is pulled away from back 12 of sofa 10, like the footboard in the five-panel version. Panel 37, which is fixedly attached to braces 60*e*, 62*d*, 64*d*, and 66*e*, slides out from below panels 30, 32, and 34. When footboard 22 is fully extended, the U is unfolded to form a flat panels 30, 32, and 34 for mattress 40, which is substantially coplanar with panel 37 as shown in FIG. 3. As discussed below, it is also preferred that at least a portion of panel 34 move (after panel 37 slides out from under the U) downwardly slightly a distance approximately the same as the width of panel 37 so that panels 30, 32, 34, and 37 are substantially coplanar.

In the preferred embodiment, mattress cover 51 is permanently secured to a portion of panels 30 and 34 and stored in sofa 10 when in the seating position. Preferably, the proximal (or head) end of mattress cover 51 is secured adjacent the proximal end of panel 34. Because the head end of mattress 40 moves only slightly during retraction and extension of sleeper assembly 35, if at all (no more than about 8 inches), the position of pneumatic system 90 relative to the portal in mattress 40 changes only slightly. Thus, the connection between pneumatic system 90 and mattress 40 is likely more reliable than in systems with undue relative movement between the pneumatic system and the mattress.

When mattress 40 is stowed in sofa 10, the entire deflated mattress 40 fits inside the U formed by panels 30, 32, and 34. The distal end of mattress 40, which lies on panel 37 when mattress 40 is deployed, is folded back onto the rest of mattress 40 before folding panels 30, 32, and 34 into a U. Once the mattress is so folded, panels 30, 32, and 34 are folded into their stowed, U-shape, to substantially contain the entire mattress 40.

Similar to the five-panel version, the deflated mattress 40 is unfolded as panels 30, 32, and 34 are unfolded into the sleeping position. The foot end of mattress 40 is unfolded onto panel 37. In the preferred embodiment, mattress 40 includes a stiffener disposed between the bottom surface 46 and cover 51 of mattress 40. The stiffener, which can be plasticized cardboard, wood, or any other suitable material, allows the user to fold and control the distal third or quarter of mattress 40 better when deploying it on top of panel 37.

Once mattress 40 is positioned on support panels 31 , it can be inflated using pneumatic system 90 as described in section IV.D of this document. After use, mattress 40 is deflated and the distal portion of mattress 40 is disconnected from panel 37. To move the sleeper assembly to the seating position, the distal portion of mattress 40 is folded onto the rest of mattress 40 and panels 30 and 32 are folded to form the "U" shape with panel 34. The user then pushes footboard 22 toward back 12 of sofa 10. As footboard 22 moves, panel 37 reaches the point that it is positioned next to panel 34.

The applicants contemplate various ways of positioning panel 37 below panel 34. One option is that panel 34 is positioned with a gap between it and mattress frame 58 and panels 30, 32, 34, and 37 are thin, e.g., an eighth (⅛) to a quarter (¼) of an inch thick. When such panels are deployed in the sleeping position, the panels 31 would not be coplanar, the top of panel 37 would be lower than the top of panels 30, 32, and 34. However, the user sleeping on mattress 40 likely would not notice the slight irregularity in the surface formed by panels 31.

Another way to position panel 37 below panel 34 is to allow panel 34 to move vertically upward during the transition from the sleeping position to the seating position to make room for panel 37. For example, panel 34 may be attached to mattress frame 58 by linkages that allow panel 34 to move between lowered and raised positions. In the raised position, panel 37 is disposed below panel 34. When panel 37 is pulled from below panel 34 and moved to the sleeping position, panel 34 drops in height until it is disposed on mattress frame 58. Thus, when in the sleeping position, panels 34 and 37 have coplanar top surfaces. To move the sleeper assembly from the sleeping to the seating position, panel 37 is pushed toward panel 34. The distal edge of panel 37 may be beveled so that panel 37 lifts panel 34 as panel 37 slides under panel 34. To reduce friction when sliding panel 37 below panel 34, the bottom of panel 34 may include wheels that engage the upper surface of panel 37. The wheels are preferably positioned so that they do not contact mattress frame 58, which could result in panel 34 not being planar with panel 37 when the sleeper assembly is in the sleeping position.

Another contemplated embodiment is to use a gearing system that raises and lowers the height of panel 34. For example, the gears can cause the links to move from the lowered position to the raised position, which correspondingly raises panel 34 to allow panel 37 to be disposed under panel 34.

Figure 26:
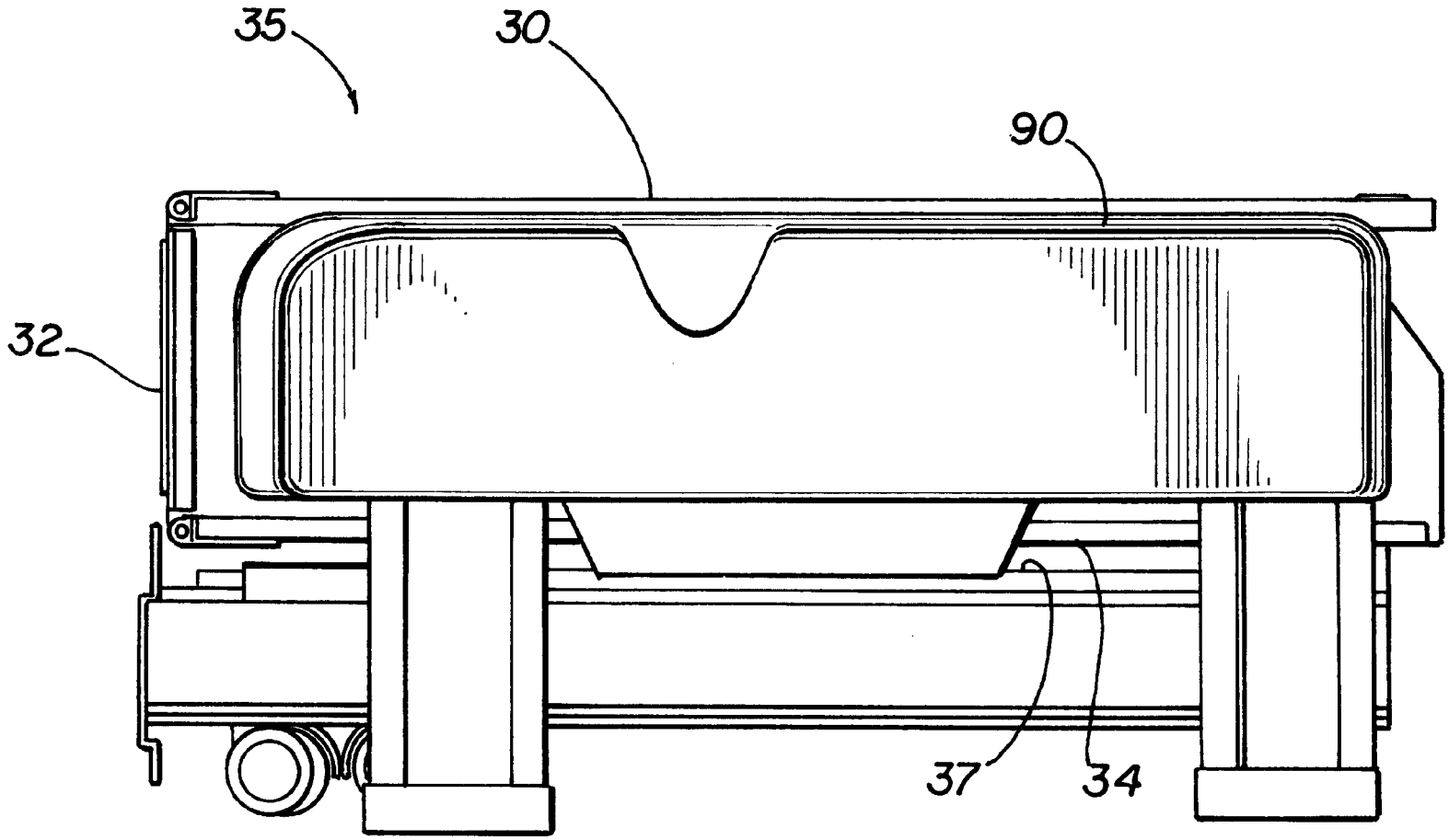
FIG. 26 is a elevational view of a sleeper assembly depicting the manner in which some of the panels in the mattress support subassembly are lifted to allow another support panel to slide under the lifted portion.

FIG. 26 illustrates still another variation of the means for positioning panel 37 below panel 34 encompasses positioning panel 30 in the seating position so that it causes panel 34 to be raised. In one embodiment, a horizontally oriented support prop is connected to the medial side of each of the arms 14 and 16 of sofa 10. When panel 30 is folded from the sleeping position to the seating position, panel 30 is placed on the upper ledge of the support prop, which causes panel 32 and thus panel 34 to be lifted above mattress frame 58. That is, the support prop positions panel 30 higher than where panel 30 would otherwise be located above panel 34 based on the length of panel 32, causing panel 34 to be lifted off mattress frame 58. The raised panel 34 allows panel 37 to slide under panel 34.

Figure 21:
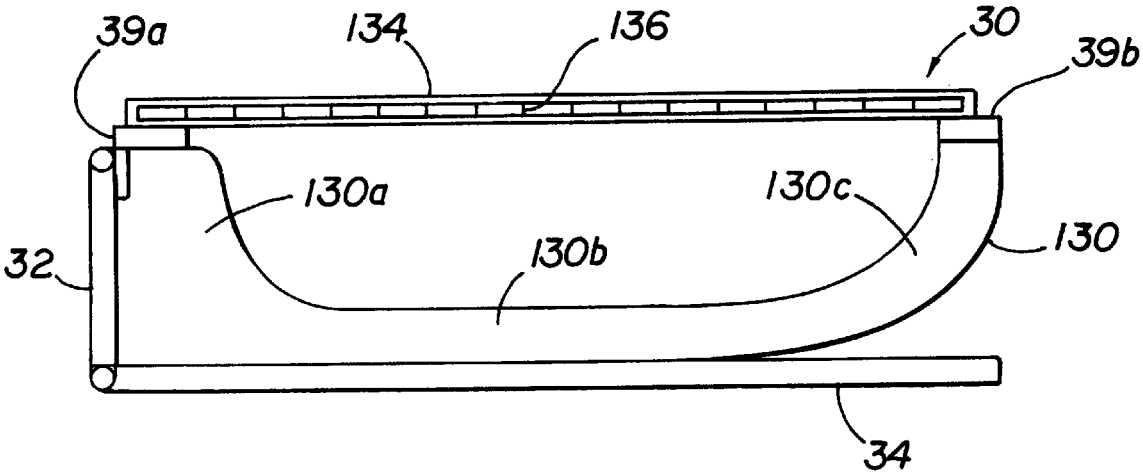
FIG. 21 is a elevational view of a mattress support subassembly depicting the manner in which the seating subassembly is supported on a seating base.
Figure 22:
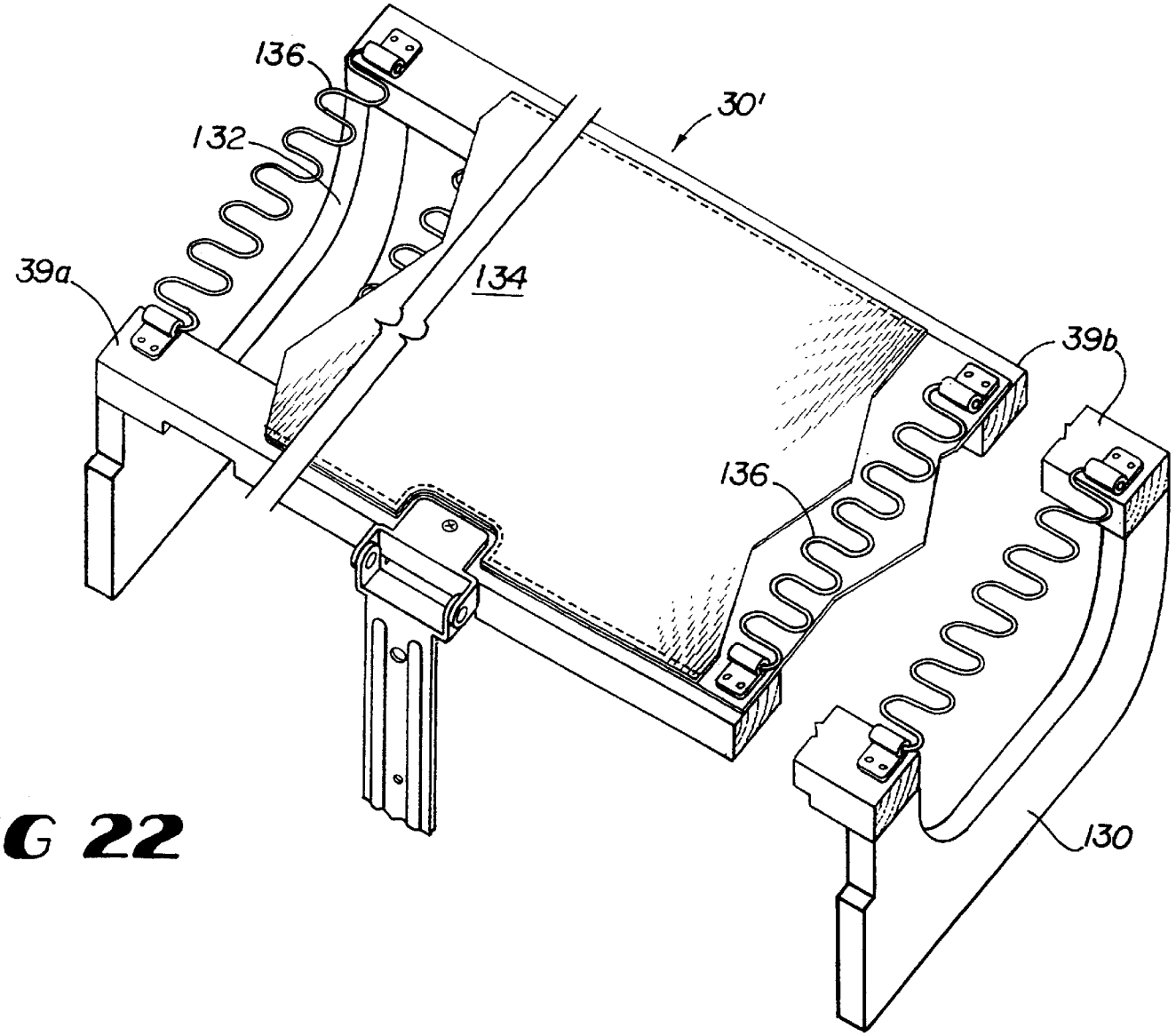
FIG. 22 is a perspective, cutaway schematic of the seating subassembly shown in FIG. 21.
Figure 23:
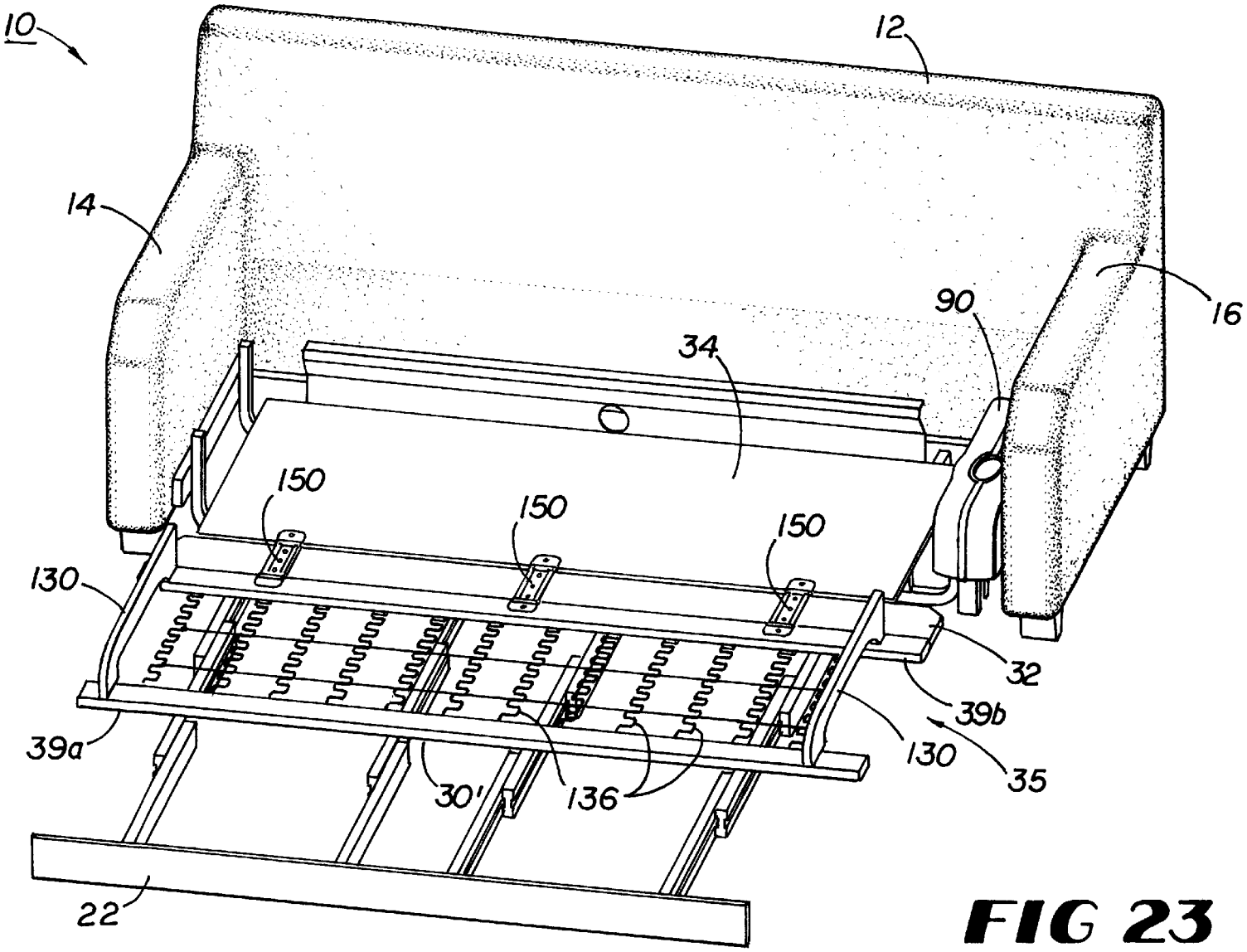
FIG. 23 is a perspective view of an embodiment of a sleeper sofa incorporating the seating subassembly shown in FIGS. 21 and 22 with the sleeper assembly extended to the sleeping position.

A variation of the "U" section of the four-panel version is shown in FIGS. 21–23, which is an elevational schematic illustration. Panels 34 and 32 are essentially the same panels as described above. However, panel 30 is replaced by a seating subassembly 30'. Seating subassembly 30' comprises a suspension member defining a seating plane that is constructed of a plurality of sinuous springs 136 (or another suitable suspension member like an elastomeric strap or panel) within a padded cover 134 and suspended between a longitudinal outer rail 39*a* and a parallel inner rail 39*b*. The outer rail 39*a* and inner rail 39*b* are rigidly held parallel to each other by bowed support rails 130 and 132. When sleeper assembly is in the seating position, support rails 130 and 132 support outer rail 39*a* and inner rail 39*b* above panel 34, which acts as a seating base. Because support rails 130 and 132 lack structure in the seating plane defined by the suspension member, the suspension member is free to flex downward under the weight of a user sitting on seat cushions 18 placed atop the suspension member. Thus, seating subassembly 30' provides a superior seating surface when compared to panel 30 because it is virtually identical to the seating surface used in conventional non-sleeper sofas. Seating subassembly 30' has no hard points under cushions 18 except for outer rail 39*a* and inner rail 39*b*, both of which are present in conventional non-sleeper sofas (rigidly attached to the sofa frame, however).

Figure 16:
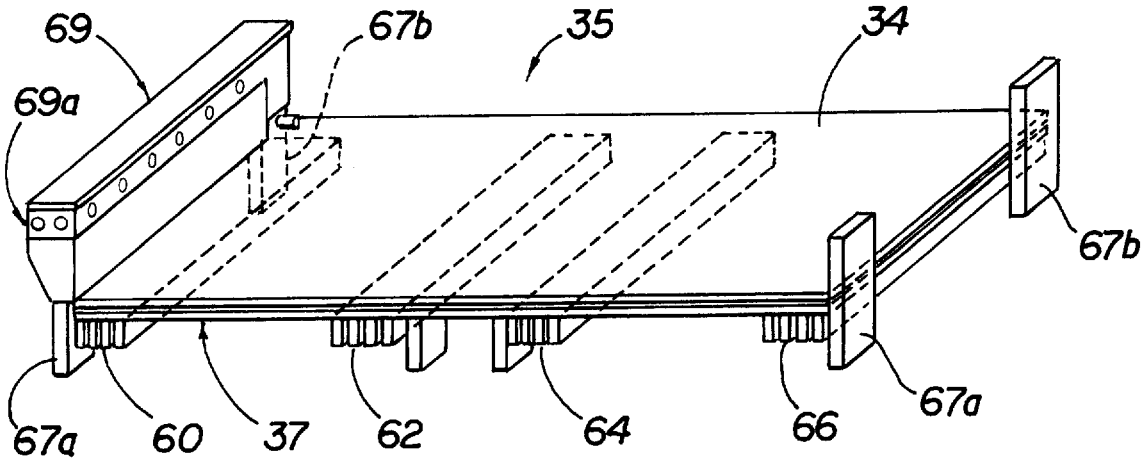
FIG. 16 is a perspective view of a portion of the mattress support subassembly illustrating a side support member with an elastomer or spring-loaded portion.

FIG. 16 is a perspective view of a portion of sleeper assembly 35, in which panels 30 and 32 and footboard 22 are omitted for clarity. The sleeper assembly 35 includes a support 69 incorporating elastomer 69*a* or springs to aid deflection when used in the sofa body. FIG. 16 further depicts panel 34 pinned to be stationarily positioned to the rear legs 67*b*. Panel 37, which is disposed below panel 34, slides outwardly away from the stationary panel 34 as discussed above in part IV.A.2. FIG. 16 also shows mattress frame 58, which includes the groups 60, 62, 64, and 66 of braces and legs 67*a* and 67*b* of sleeper assembly 35.

3. Sideways Sleeper Version

As one skilled in the art knows, conventional prior art sleeper sofas open up lengthwise so that the user sleeps perpendicular to back 12 of sofa 10. One version of the applicants' invention (not shown) is a "sideways sleeper," in which the user lays parallel to back 12. Accordingly, sofa 10 is slightly wider than a conventional sleeper sofa and mattress frame 58 is shorter when in the sleeping position. For a queen size mattress, the presently preferred sideways sleeper in the sleeping position has dimensions of about sixty inches from back 12 to footboard 22 and about eighty inches in the direction along the length of sofa 10. A primary advantage of the sideways version is easier manual operation and a smaller probability of a problem arising in the folding mechanism during the shorter travel of mattress frame 58 between the seating and sleeping positions.

B. The Serpentine Embodiments

1. First Version

Figure 5:
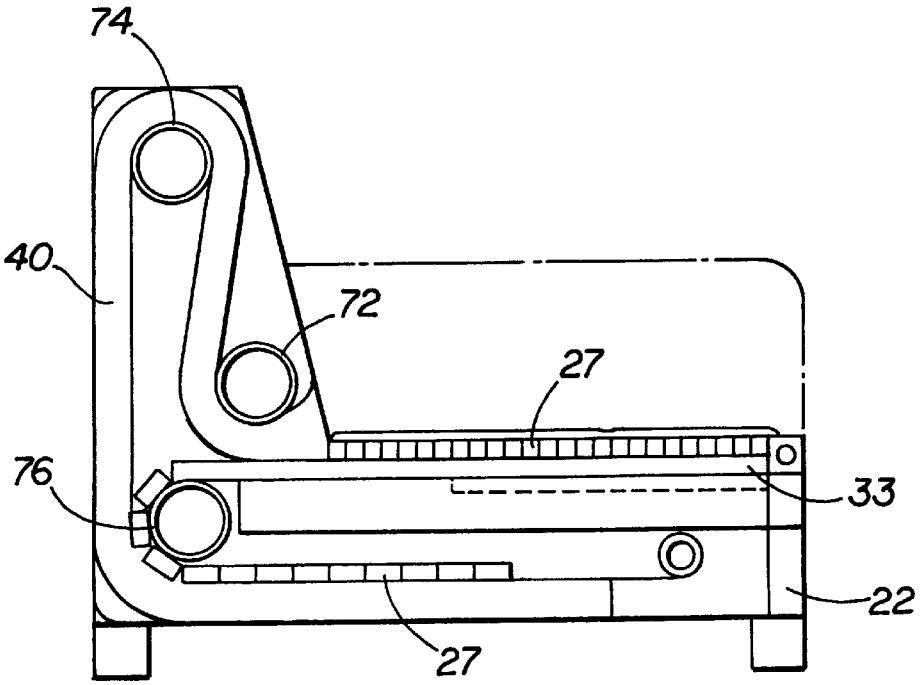
FIG. 5 is a cross-sectional side view of a first version of a serpentine embodiment of the applicants' invention shown in the seating position.

The second embodiment of the sleeper assembly 35 is the serpentine embodiment. The first version of serpentine embodiments comprises a solid panel 33 and two groups of slats, distal group 27 and proximal group 29, with groups 27 and 29 pivotally connected to opposed ends of panel 33. The slats in each of groups 27 and 29 are also pivotally connected to each other and oriented perpendicularly to groups 60, 62, 64, and 66 of braces and parallel to footboard 22. When sleeper assembly 35 is in the seating position as shown in FIG. 5, panel 33 is disposed below cushions 18 and the distal edge of panel 33 is adjacent footboard 22. Group 29 of slats is disposed below panel 33 and group 27 of slats is disposed on and supported by panel 33.

Spacing between the slats in each group can be varied based on different factors, such as the width of the slats, the material forming the slats, the inflation pressure of mattress 40, the strength of mattress 40, the maximum desired weight of the sleeper sofa, among others. Each of the slats in group 29 is preferably about two inches wide and group 27 of slats are about one inch wide. Using spaced-apart slats reduces the weight of sofa 10 compared to using all solid panels, as in the folded-support embodiments.

To position the serpentine embodiment of the sleeper assembly 35 to the sleeping position, footboard 22 and mattress frame 58 are extended away from back 12 of sofa 10 as discussed above in connection with the folded-support embodiments of sleeper assembly 35. When sleeper assembly 35 is in the sleeping position, panel 33 is pulled away from back 12 and disposed over braces 60*c* and 60*d*, 62*b* and 62*c*, 64*b* and 64*c*, and 66*c* and 66*d*. Group 27 of slats is unfolded from atop panel 33—either before or after panel 33 is pulled to its sleeping position—and disposed over braces 60*e*, 62*d*, 64*d*, and 66*e*.

When sleeper assembly 35 is moved to the sleeping position, group 29 of slats moves along a horseshoe-shaped track to form a substantially planar surface with panel 33. That is, as panel 33 is pulled away from back 12 of sofa 10, group 29 of slats correspondingly slides around the horseshoe-shaped track to lie atop braces 60*b*, 62*a*, 64*a*, and 66*b*. Thus, the upper surfaces of both groups 27 and 29 of slats and panel 33 provide a substantially planar support surface for mattress 40.

To move sleeper assembly 35 back to the seating position, panel 33 is pushed toward back 12 of sofa 10 until its proximal edge is adjacent back 12. Group 29 of slats, which is closest to the sofa body, slide around the horseshoe-shaped track to be partially disposed below panel 33 again. Group 27 of slats are folded onto the top surface of panel 33 as shown in FIG. 5.

Unlike the folded-support embodiments, mattress 40 in the serpentine embodiment is preferably separated from panel 33 and groups 27 and 29 of slats while being retracted into the sofa 10. Mattress 40 is directed around rollers in the back portion of the sofa, which are shown in FIG. 5. The flexible mattress 40 traversing around the rollers 72 and 74 and 76 in back 12 of sofa 10 pushes air out of the chamber(s) of mattress 40, thus "ringing" air out of and deflating mattress 40. For the most effective results, the chamber(s) is (are) preferably at least partially deflated prior to being directed around rollers 72 and 74.

To assist the "ringing" system, a motorized system can be used for simultaneously retracting sleeper assembly 35 and mattress 40. One embodiment, for example, can use a motor that generates a rotational output connected to a shaft that rotates to pull mattress 40 and group 29 of slats into the body of sofa 10. Other embodiments of the automated retraction system are discussed below.

As one skilled in the art will appreciate, it is advantageous to use differential gearing to retract mattress 40 faster than the sleeper assembly 35. The differential gearing can be as simple as using a shaft that has different diameters, in which one flexible cable is connected to both mattress 40 and the shaft at one of its diameters and another flexible cable is connected to both the sleeper assembly 35 and the shaft at a location having a different diameter. The respective cables wrapping around the different diameters of the shaft cause mattress 40 and the sleeper assembly 35 to be retracted at differential rates. Alternatively, a different gearing system can be used that retract the two components at a different rate relative to each other.

2. Second Version

Figure 6:
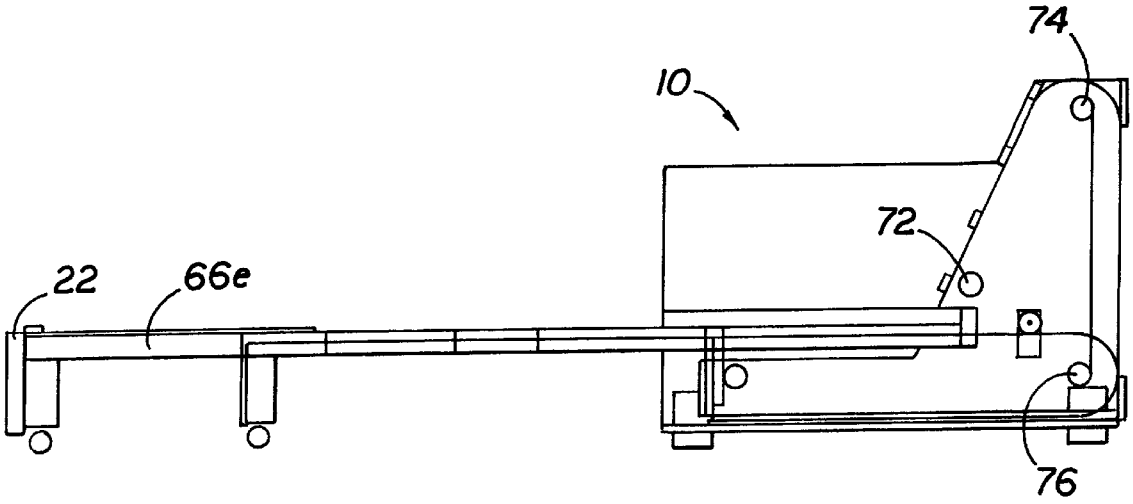
FIG. 6 is a side view of components of a second version of the serpentine embodiment shown in the sleeping position.

A second version of the serpentine embodiment, shown in FIG. 6, uses panel 33 fixedly attached to at least one of the fourth braces, similar to the four-panel version of the folded-support embodiment. Panel 33 is attached to the upper surface of braces 60*e*, 62*d*, 64*d*, and 66*e*, which are supported by wheels. The leading end of panel 33 abuts footboard 22. When mattress frame 58 is retracted, panel 33 is positioned to support seat cushions 18.

One variation of this second version of the serpentine embodiment uses a plurality of pivotally connected slats, similar to the first version of the serpentine embodiment, that forms the planar support upon which the separately stored air mattress is disposed. That is, instead of using two groups of slats in which one group is placed on each side of panel 33, this variation only uses a single group 25 of slats that covers braces 60*a*–60*d*, 62*a*–62*c*, 64*a*–62*c*, and 66*a*–66*d* when sleeper 35 is in the sleeping position. The group of slats 25 in this version are stored below panel 33 in the seating position separately from mattress 40, such as on a track similar as discussed above. Also, similar to the first version of the serpentine embodiment, mattress 40 is preferably wrapped around the rollers in the back portion of the sofa.

Another variation of the second version uses a cover 51 over mattress body 41 of mattress 40, in which the bottom portion of the cover holds a plurality of spaced-apart slats that are oriented perpendicularly to the braces and parallel to footboard 22. The slats are placed within the cover starting at approximately a third to a quarter of the length of mattress 40 away from its end disposed adjacent footboard 22. Thus, the slats are inserted beginning at the point that panel 33 ends when mattress 40 is positioned on the extended sleeper assembly 35, e.g., over the third brace. In the presently preferred embodiment, the slats have a width of two inches and are spaced two to four inches apart.

The spaced-apart slats allow mattress 40 to be retracted through the rollers in the back portion of the sofa with mattress 40. That is, based on the orientation of the slats, mattress 40 having the slats disposed in its cover can traverse through the rollers to allow the deflation of the air chambers. This version has the advantage that mattress 40 and the slats are retracted together, instead of separately.

Another variation uses a webbing disposed between mattress cover 51 and the chamber(s) in mattress body 41. The webbing provides support for the chamber(s) disposed over it, yet can be rolled around the rollers. The webbing can consist of a polymer or other material that is supportive against mattress frame 58 and can still traverse through the rollers.

For these variations of the second version of the serpentine embodiment, the foot end of mattress 40 adjacent footboard 22 is preferably detachably secured to a portion of panel 33. When in the seating position, most of the deflated air mattress is stored in the back portion of the sofa and the seat cushions are disposed on panel 33.

3. Sideways Sleeper

As discussed for the folded-support embodiments, the sideways sleeper version can also be used for the serpentine embodiment. The same advantages apply as discussed for the folded support-embodiments because the sideways sleeper version requires less movement between the sleeping and seating positions, which simplifies the design and reduces the chance of problems occurring.

C. The Mattress

Still another aspect of the applicants' invention is a mattress 40 better adapted to be used with a sleeper sofa. Conventional air mattresses use air chambers that have a rubber coated cloth surrounded with foam. The foam can be an "egg crate" material disposed within a sleeve that circumscribes the edges of each air chamber with the air chambers of the mattress detachably secured to the sleeve. This foam, however, is not ideal for use with mattress 40 according to the applicants' invention because it does not easily compress or fold when mattress 40 is stowed in sofa 10. Such a foam edge is particularly problematic when using rollers to deflate mattress 40 or when mattress 40 is stowed into a small storage space within sofa 10. Another drawback of the foam is that consumers generally do not like the feeling of the texture when they lie upon a foam mattress.

However, without a side support surrounding the edges of the chamber(s), mattress 40 lacks the desired structural support. For example, when a user sits on the side of mattress 40 it tends to rollover and is mushy. The applicants' have developed to approaches to increase the peripheral structural support of mattress 40.

1. Single-Chamber Mattress Body

Figure 9:
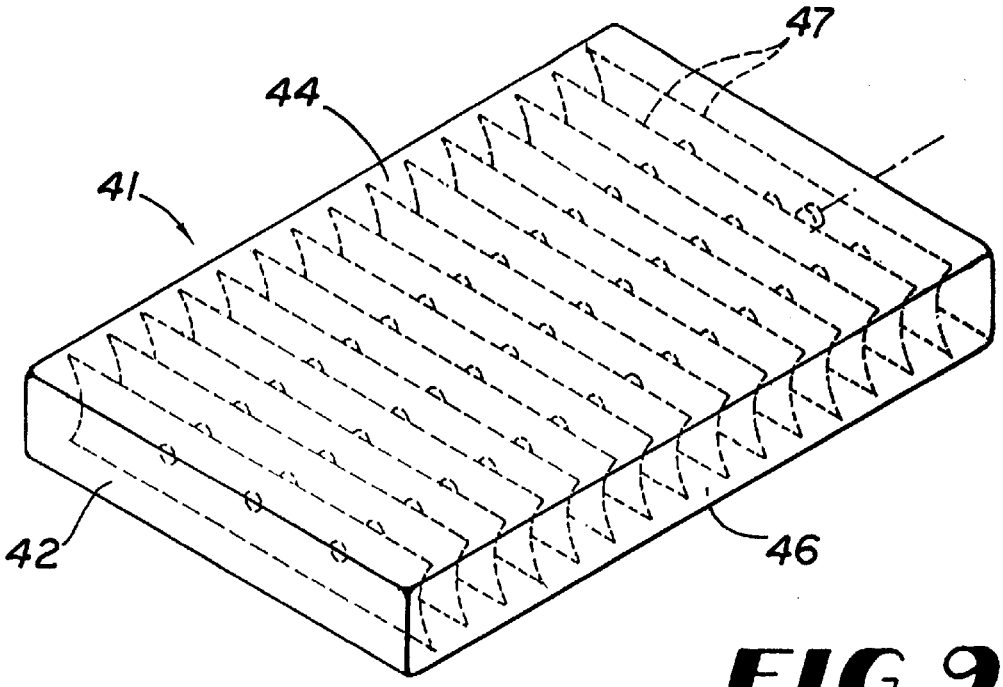
FIG. 9 is a perspective schematic view of one embodiment of a mattress according to the applicants' invention having a single chamber and optional baffles.

FIG. 9 illustrates a single chamber mattress 40 including mattress body 41 with top 44, bottom 46, and sidewall 42 defining chamber 45. A plurality of baffles 47, each with a plurality of apertures in it, are connected to top 44 and bottom 46 within chamber 45 to control the flow of air from one portion of chamber 45 to another. This embodiment of mattress 40 is the least complex and thus easiest to manufacture.

Another embodiment of a single-chamber mattress 40 may include baffles 47 that do not extend to the sidewall 42 of mattress body 41. The effect of such baffles is that the top and bottom surfaces of lateral portions 42*a* and 42*b* protrude above the top 44 and bottom 46 of the remainder of mattress body 41 (see FIG. 11A). These lateral portions 42*a* and 42*b* deter the user from rolling over the edge of mattress body 41.

2. Multi-Chamber Mattress Body

Figure 10:
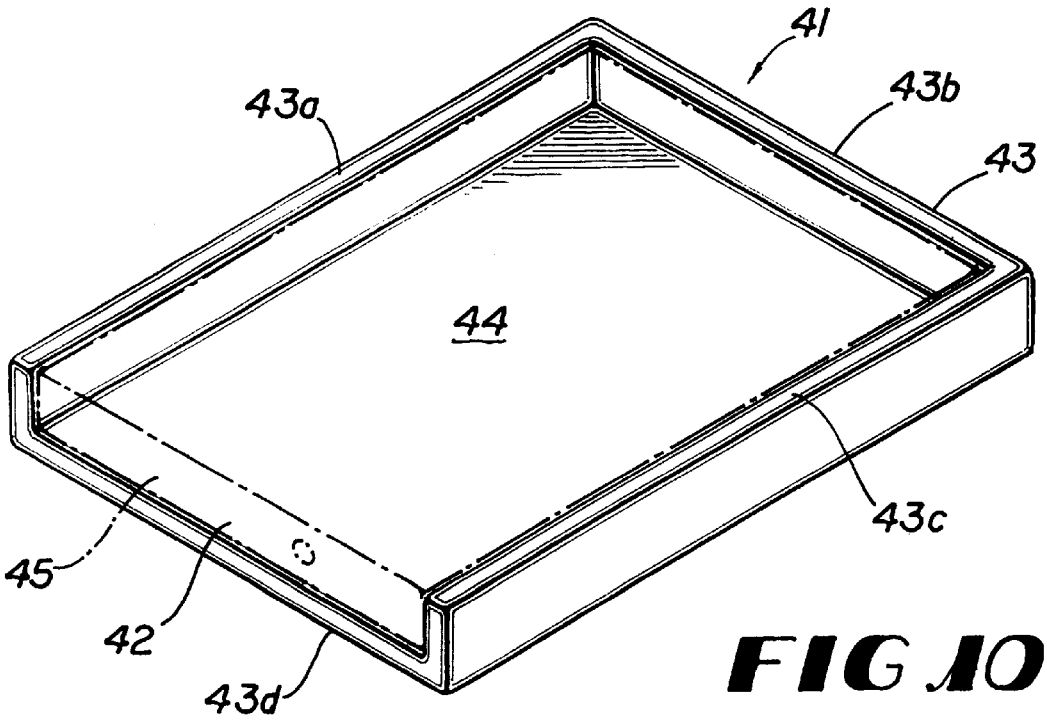
FIG. 10 is a perspective view of one embodiment of a multi-chamber mattress according to the applicants' invention in which a first chamber, which is shown in broken lines, to reveal how the first chamber is supported on three sides and its bottom by a second chamber.

FIG. 10 illustrates one embodiment of multi-chamber mattress 40 comprising a generally rectangular first chamber 45 surrounded by a horseshoe-shaped second chamber 43. The second chamber 43 defines a cavity into which first chamber 45 is complementarily received. The air chamber 45 can be detachably secured to second chamber 43, if desired, by "VELCRO®" fasteners, snaps, or other suitable fastening systems. Chamber 43 can have other shapes, such as a design having either two opposed longitudinal sides or four sides that completely surround chamber 45, instead of three sides as in the horseshoe-shaped chamber 43 shown in FIG. 10. The preferred thickness of the side portions 43*a*, 43*b*, and 43*c* and bottom portion 43*d* of chamber 43 is about one and a half inches. Another design option is that the bottom portion 43*d* of chamber 43 does not inflate, similar to an inflatable children's swimming pool.

In the horseshoe-shaped embodiment of chamber 43 shown in FIG. 10, the head end of chamber 45 is placed so that it does not contact any side portion 43*b* of chamber 43 to provide free access to the valve and portal for inflation and deflation. Chamber 43 is inflated to a high air pressure so that it is very firm and rigid. Thus, chamber 43 provides the desired structural support, despite a lower pressure in chamber 45. Chamber 43 also provides a firm foundation for chamber 45 similar to the effect of a box spring on a conventional spring mattress. Thus, the slats used in the serpentine embodiment can be spaced apart at a greater width compared to using chamber 45, inflated to a lower pressure, disposed directly on top of the slats.

Figure 11:
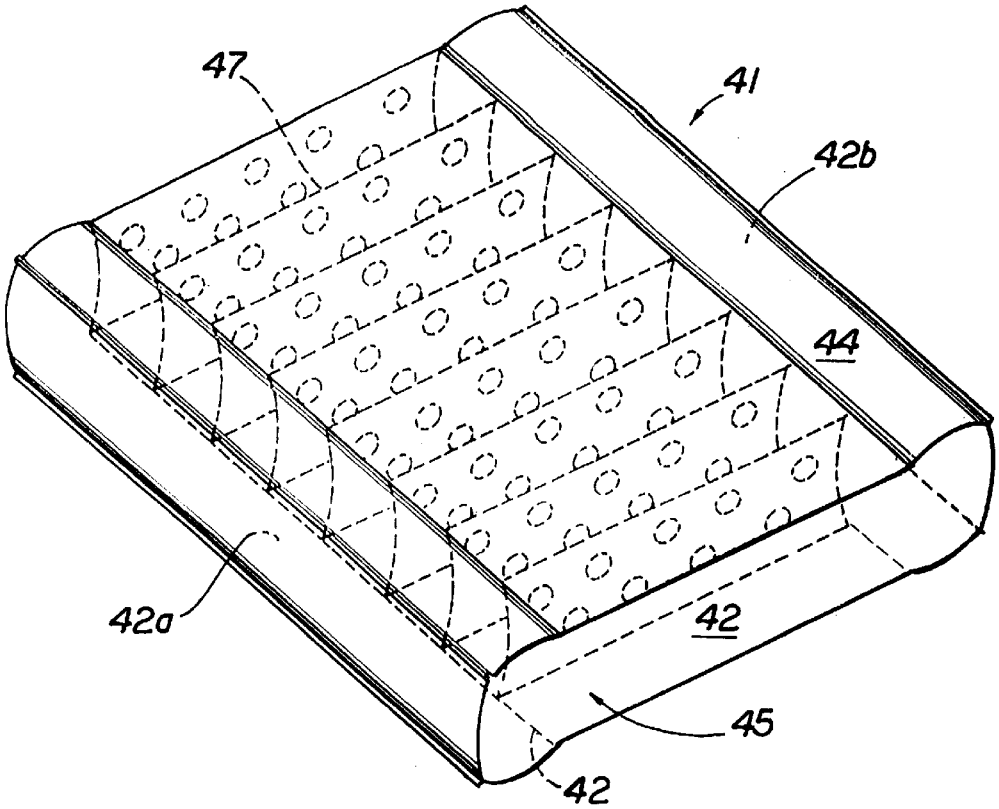
FIG. 11 is a perspective view of a second embodiment of a mattress according to the applicants' invention having an inner chamber along with optional baffles.
Figure 11A:
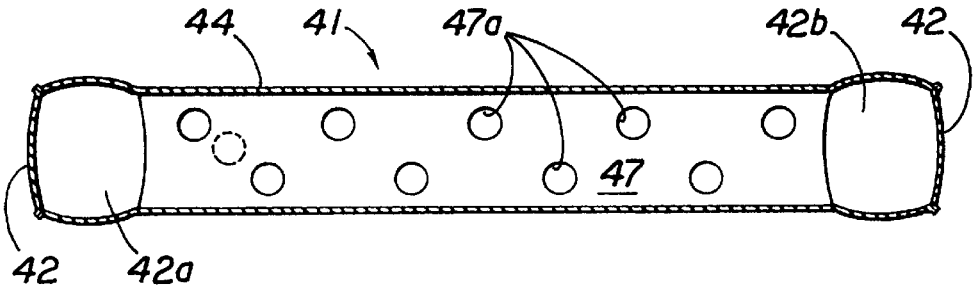
FIG. 11A is a cross-sectional view taken along line 11A—11A of the mattress shown in FIG. 11.
Figure 11B:
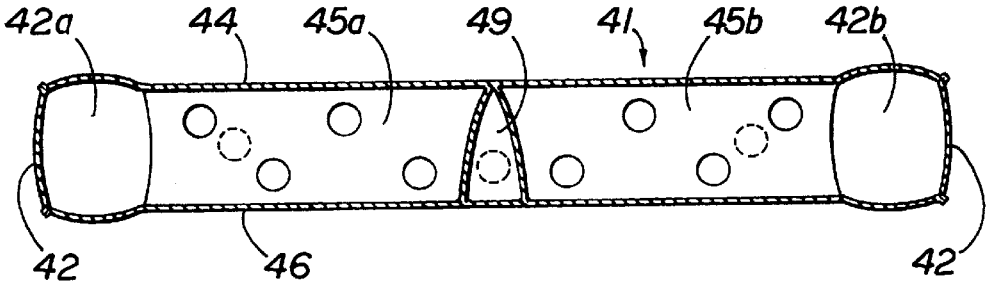
FIG. 11B is cross-sectional view of a mattress similar to the mattress of FIGS. 11 and 11A, but with a divider chamber located near the longitudinal centerline of the mattress that divides the mattress into three chambers.

FIG. 11B depicts a multi-chamber mattress body 41 that is a variation of mattress 41 depicted in cross section in FIG. 11A. In order to deter the user from rolling from one side of mattress body 41 to the other, a central chamber 49 may be interposed in mattress body 41 to divide chamber 45 into two, separately pressure-controlled chambers 45*a* and 45*b*. Because the pressure in chambers 45*a* and 45*b* can be separately controlled, two users can customize their respective sleeping surfaces to suit their individual tastes.

Figure 12:
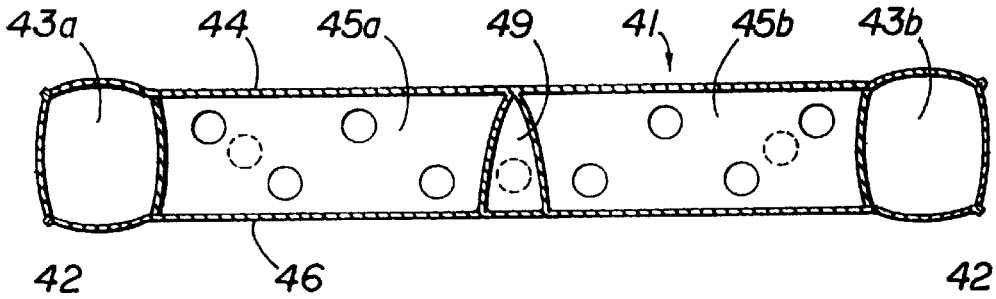
FIG. 12 is a cross-sectional view of a mattress similar to the mattress of FIGS. 11 and 11A, but with a third type of chamber located along the lateral edges of the internal chambers.

FIG. 12 illustrates another embodiment of a multi-chamber mattress 40 may include two separate supportive chambers 43*a*' and 43*c*' can be attached on two opposing lateral sides of chambers 45*a* and 45*b* as shown in FIGS. 11 and 11A. Just as with chamber 43 in embodiment of mattress 40 shown in FIG. 10, chambers 43*a*' and 43*c*' are inflated at a higher pressure than either of chambers 45*a* or 45*b*. Also shown in the embodiment of mattress 40 shown are internal baffles 47 with apertures 47*a* designed to control flow of air throughout chambers 45*a* and 45*b* and provide a pillow-like upper surface 44 of mattress 40. In the embodiment shown, baffles 47 are attached along their top and bottom edges to the top 44 and bottom 46 of mattress 40, but baffles 47 do not extend into chambers 43*a*' and 43*c*'. Therefore, chambers 43*a*' and 43*c*' will be of greater height than chambers 45*a* and 45*b* when all are inflated, which enhances the rollover prevention function of chambers 43*a*' and 43*c*'.

Figure 12A:
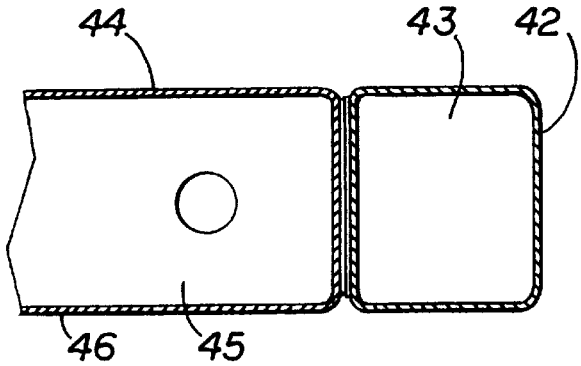
FIG. 12A is a partial cross-sectional view of a lateral portion of an embodiment of a mattress similar to that shown in FIG. 12 in which a hook and loop fastener system is used to allow the two types of chambers in the mattress to be selectively attached and detached from each other.
Figure 12B:
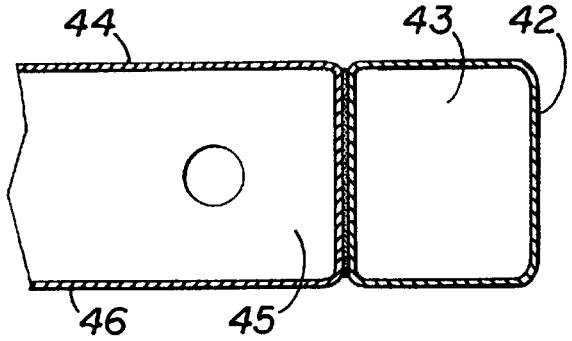
FIG. 12B is a partial cross-sectional view of a lateral portion of another embodiment the mattress similar to that shown in FIG. 12 in which a permanent method is used to connect the two types of chambers in the mattress to each other.
Figure 12C:
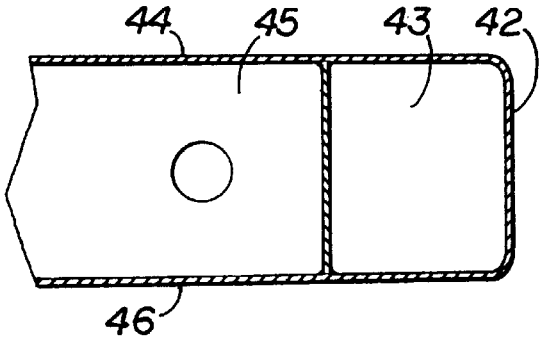
FIG. 12C is a partial cross-sectional view of a lateral portion of another embodiment the mattress similar to that shown in FIG. 12 in which the two types of chambers in the mattress share a common wall.
Figure 13A:
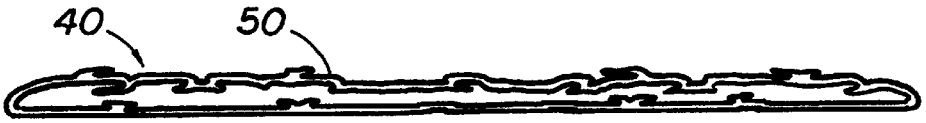
FIGS. 13A and 13B are elevational views of any of the mattresses shown in FIGS. 11—11 in the deflated and inflated states respectively.
Figure 13B:
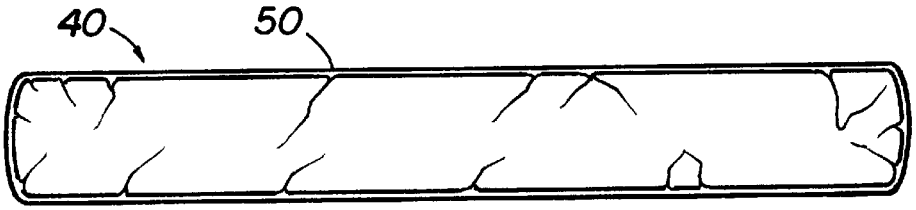

FIGS. 12A–12C illustrate exemplary ways in which any one of chambers 43, 43*a*', and 43*c*' may be attached to chamber 45. The attachment methods differ essentially by the degree to which sidewall 42 of chamber 45 is integrated with the adjacent inner sidewall of one of chambers 43, 43*a*', and 43*c*'. FIG. 12A illustrates attaching one of chambers 43, 43*a*', and 43*c*' to chamber 45 using complementary hook-and-loop fasteners. FIG. 12B illustrates bonding one of chambers 43, 43*a*', and 43*c*' to chamber 45 using adhesive or some other appropriate bonding method. FIG. 12C illustrates an embodiment in which a portion of sidewall 42 of chamber 45 is common to a portion of the inner sidewall of one of chambers 43, 43*a*', or 43*c*'.

3. Controlling Edge Collapse Using a Mattress Cover

The second way in which the edge of the mattress 40 may be prevented from collapsing is to place mattress body 41 into mattress cover 51 that is slightly smaller than mattress body 41 when it is inflated. In such an arrangement, cover 51 supports sidewall 42 of mattress body 41 because body 41 expands to fill the comers and edges of cover 51. The drawback of this design compared with the dual chamber embodiment is that the user has less control over the firmness of mattress 40.

4. The Mattress as It Is Positioned Within the Sleeper Assembly

In the four- and five-panel versions of the folded-support embodiment of sleeper assembly 35 shown in FIGS. 3B and 4A, mattress 40 is preferably detachably secured to one or more of panels 31 of sleeper assembly 35 and stored adjacent and between the panels when stowed in the seating position. For example, complementary hook-and-loop fasteners, commonly known as "VELCRO®" fasteners may be appropriately attached to mattress 40 and certain panels of support panels 31 . The fasteners can alternatively be complementary snap fasteners. Other fasteners known in the art for detachably connecting separate components can also be used.

When sleeper assembly 35 is in the sleeping position, mattress 40 is pre-positioned on support panels 31 and ready to be inflated as shown in FIG. 1D. As one skilled in the art appreciates, air mattress 40 comprises an inflatable flexible mattress body 41 made of any suitable sheet-like, flexible material enclosing at least one pressure-tight chamber. Mattress body 41, which is preferably enclosed within cover 51 to form mattress 40, preferably includes opposing upper and lower surfaces 44 and 46 respectively connected by sidewall 42 so that, when inflated, mattress 40 assumes a generally rectangular shape in plan view. Mattress 40 has length and width dimensions substantially the same as the length and width of the mattress support subassembly when it is in the sleeping position.

To inflate and deflate each chamber disposed within mattress body 41, one or more tubular fittings defining portals (not shown) are provided through the walls of mattress body 41 to communicate with each chamber. Each portal is preferably fixed in the sidewall 42 of mattress body 41 and a valve or other suitable mechanism is used to close or open the portal. For example, a valve comprises a flange integrally connected to a cylindrical, internally threaded, closure valve body and a mating, externally threaded, closure plug. In another embodiment, the closure may be complementary barbed hose fittings. The portal is preferably recessed within mattress body 41 so that the closure plug is substantially flush with the sidewall 42 when the portal is closed. The closure plugs are also preferably attached to mattress 40 by a chain so that they are always conveniently available to the user.

When a valve is used in the mattress 40, the portals are opened by overcoming the check valve springs with higher pressure or unscrewing and removing the valve caps or opening the valve by penetrating the valve with another body. A pneumatic system (one embodiment of which is described in detail below) pressurizes the chamber(s) within mattress body 41 until the correct mattress firmness is obtained. Alternatively, mattress 40 can include internal springs that separate the upper and lower walls 44 and 46 of mattress 40 and draw ambient air into the chamber(s) through the valve to inflate mattress 40. When mattress 40 is appropriately pressurized, the portals are closed to contain the air so that mattress 40 remains pressurized during use.

D. The Pneumatic System

In one contemplated embodiment of sofa 10, mattress 40 is inflated and deflated with pneumatic subassembly 90

Figure 7:
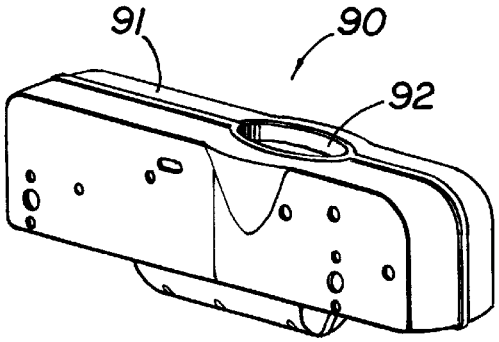
FIG. 7 is a perspective view from above of an embodiment of a pneumatic system suitable for use in the sleeper sofa according to the applicants' invention.

(FIG. 7), which is permanently stored in a portion of one or both of sides 14 and 16 or in back 12 of sofa 10. FIG. 7 generally depicts pneumatic system 90, which comprises a single-direction or reversible blower, a valve, a blower portal, and control panel with controls. If necessary, the user connects the blower portal of pneumatic assembly 90 to the portal on mattress 40 using a hose (not shown). Accordingly, the portal on mattress 40 is preferably positioned close to back 12 of sofa 10. In the preferred embodiment, the type of electrical power required to operate pneumatic assembly 90 is a 120V AC power source, normal residential utilities in the United States. Pneumatic assembly may also use power supplied by batteries or a rechargeable electrical supply so that the blower is operable during loss of electrical power. It is also preferred to use a spool to hold the electrical cord for pneumatic assembly 90, such that the spool automatically winds the cord after it is removed from an electrical outlet.

As one skilled in the art will appreciate, pneumatic assembly 90 can inflate mattress 40 to a desired firmness, which the user can alter as desired. Sleeper assembly 35, when in the sleeping position, provides a secure, level surface for mattress 40 to ensure maximum comfort compared with conventional mattresses on conventional wire mesh frames, even if the user wants a soft sleeping surface. Sleeper assembly 35 also reduces the risk of damaging mattress 40, as might occur if mattress 40 were used on a conventional wire mesh support. Also, because the user can choose the firmness or softness of mattress 40, the applicants' invention is much more comfortable than a conventional, non-adjustable, flimsy mattress on a wire mesh with protruding hinge bars.

To deflate mattress 40 after use, the check valves are bypassed to allow air to escape from the chamber(s). When the pressure in the chamber(s) equalizes with the head loss of the air flow through the portal, mattress 40 will be substantially deflated. The remaining air can be removed by compressing the chamber(s) so that the internal air pressure exceeds the head loss through the portal or by creating a vacuum by reversing the inflation pump. To compress the chamber(s) to allow more air to escape, mattress 40 can be folded onto itself by moving panels 30 and 32 to be in the seating position, in which panel 32 is oriented perpendicular to panel 34 and panel 30 is disposed over panel 34 as is shown in FIG. 4A. The portion of mattress 40 extending out of the space between panels 30 and 34 can be manually compressed to ensure that mattress 40 is deflated to a small enough size that it will fit in back 12 of sofa 10. The portals usually remain open after mattress 40 has been deflated.

Thus, mattress 40 is well suited for use in a sleeper sofa according to the applicants' invention to provide a comfortable sleeping surface while, at the same time, being capable of folding into a limited space provided in the frame. In fact, mattress 40, when deflated, requires less space than a thin conventional spring mattress and, when inflated, provides far more support than the conventional mattress. Mattress 40 also provides greater comfort than a conventional bed mattress.

E. The Footboard

The applicants' invention also includes an improved footboard 22. Instead of using a single-piece footboard, footboard 22 preferably includes two pieces to ease manufacturing of sofa 10. The first piece is upholstered and exposed when sofa 10 is in the seating position. The second piece has two sides; one side connects to braces 60*e*, 62*d*, 64*d*, and 66*e* of mattress frame 58 and the opposing side complementarily engages the back side of the first, upholstered piece. Thus, during manufacturing, the first piece can be upholstered in one location and the second piece can, concurrently, be attached to the mattress support in another location. When the respective pieces are assembled, the first piece can be attached to the second piece by sliding it onto the second piece, using fasteners, or other means known in the art. Preferably, the second piece nests within the back portion of the first piece.

This aspect of the applicants' invention has additional advantages over conventional footboards. For example, the two pieces can be formed of different materials, e.g., one piece formed of wood and the other piece formed of plastic or other polymer. Also, the two pieces can be arranged to hide the screws or other fasteners used to connect the upholstery to the first piece. Furthermore, the design allows the user to repair or reupholster the first piece if it becomes damaged, without requiring extensive dismantling of the sleeper sofa.

F. Automatic Retraction System

The versions of the applicants' invention can also be operated by an automated means for moving the mattress support and mattress 40 between the sleeping and seating positions. Two contemplated embodiments of the automated means, in addition to the version of the motor and shaft discussed above in the serpentine embodiment section, are a chain that pushes and pulls the braces and a pulley system.

1. Pulley System Embodiment

Figure 14:
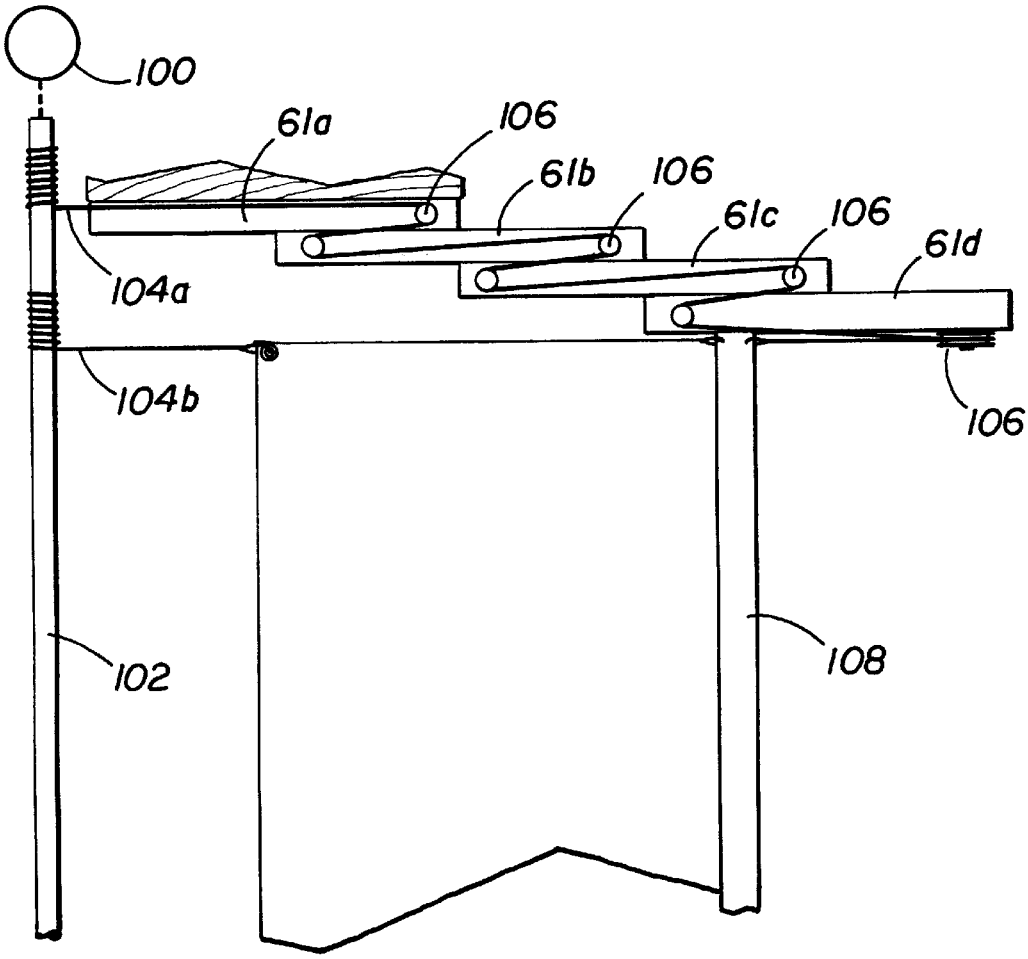
FIG. 14 is a top plan view, partially in schematic, of a pulley system of an automated means for moving the sleeper sofa between the sleeping and the seating positions.

As shown schematically in FIG. 14 for the pulley embodiment, four braces 61*a*, 61*b*, 61*c*, and 61*d* are aligned in a side-by-side relationship. Brace 61*a* is fixedly attached to sofa 10 and braces 61*b*, 61*c*, and 61*d* slide longitudinally relative to brace 61*a*. FIG. 14 also schematically shows a reversible motor 100 that generates a rotational output, which drives a shaft 102. The shaft 102 is connected to two flexible cables 104*a* and 104*b*. The cables 104*a* and 104*b* wrap around the shaft 102 in different directions so that cable 104*a* winds when the shaft 102 turns one direction and cable 104*b* concurrently unwinds.

As will also be noted, cable 104*a* is directed through a series of pulleys 106 and 108 that are rotatably attached to the braces 61*a*, 61*b*, 61*c*, and 61*d*. Braces 61*b*, 61*c*, and 61*d* have both a front pulley 106, located at the forward end of the respective braces, and a back pulley 108, located adjacent the rear ends of the braces 61*b*, 61*c*, and 61*d* that are closest to back 12 of sofa 10. Brace 61*a* has only a front pulley 106. When the braces are retracted into the seating position, the front pulleys 106 and back pulleys 108, respectively, are aligned with each other. Cable 104*a* interweaves through the pulleys and is securely attached to a transverse member 110 that is fixedly connected to mattress 40. Cable 104*b* is securely attached to the opposite side of the transverse member 110, without being interwoven around any pulleys.

When the reversing motor 100 turns in a first direction to cause cable 104*a* to wrap around the shaft 102, the length of the cable 104*a* shortens between the portion securably attached to the transverse member 110 and the rotating shaft 102. Accordingly, the braces 61*a*, 61*b*, 61*c*, and 61*d* and transverse member 110 must move to compensate for the shortened length, which results in braces 61*a*, 61*b*, 61*c*, and 61*d* moving longitudinally. That is, to compensate for the shortened length, the rear pulley 108 on one brace is pulled to be adjacent the front pulley 106 on the adjacent brace. Likewise, the transverse member 110 is pulled to be adjacent the front pulley 106 on brace 61*d*. When cable 104*a* reaches its shortest length without breaking, the braces 61*a*, 61*b*, 61*c*, and 61*d* are moved to the sleeping position and the transverse member 110 is moved to be adjacent the front pulley 106 on brace 61*d*.

In conjunction, cable 104*b* unwinds from the shaft 102 as it turns in the first direction, which allows the transverse member 110 and braces to move in response to cable 104*a*. Thus, the system automatically moves the braces 61*a*, 61*b*, 61*c*, and 61*d* to the sleeping position and the transverse member 110 pulls the end of mattress 40 to footboard 22. A limit switch or other means can be used to stop the motor 100 when the braces 61*a*, 61*b*, 61*c*, and 61*d* and mattress 40 reach the sleeping position.

To move braces 61*a*, 61*b*, 61*c*, and 61*d* and mattress 40 to the seating position, the direction of the motor 100 is reversed so that the shaft 102 turns in an opposite second direction. Cable 104*b*, accordingly, becomes taut and pulls the transverse member 110 toward the shaft 102 and cable 104*a* unwinds from around the shaft 102. Thus, the process is reversed so that the braces are moved to the seating position and mattress 40, which is attached to the transverse member 110, is pulled back. This automated retraction/extension mechanism can be used for the different embodiments of the applicants' invention described in this document. However, the transverse member 110 would not be attached to mattress 40 for the folded-support embodiments of the mattress support subassembly, so the system would move only the braces and the mattress would be manually unfolded after the braces were in proper position.

It is also contemplated that the shaft 102 extends the width of the sofa and two pairs of cables 104*a* and 104*b* are each individually attached to a respective group of braces on either side of the mattress support. Another option is using two motors 100, one connected to each end of the shaft 102 that synchronously rotate to increase reliability and to handle the torque of moving the braces and mattress 40 between the sleeping and seating positions.

2. The Push/Pull Chain

Figure 15:
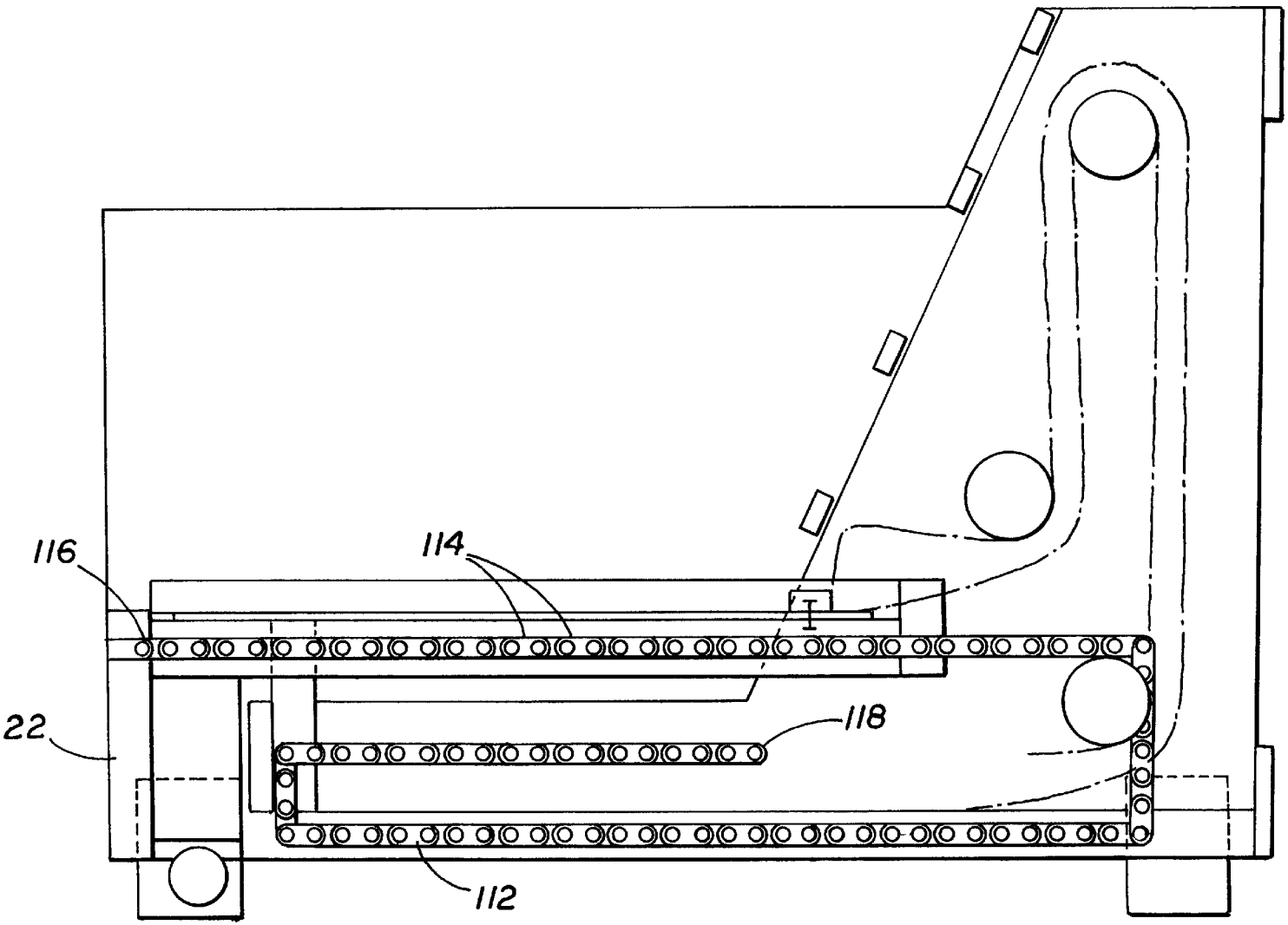
FIG. 15 is a cross-sectional view of an embodiment of a sleeper sofa having an automated mattress frame retraction system taken through a plane cutting the sofa adjacent one end of the sofa.

A second automatic retraction/extension mechanism is a chain system, which performs the same function as the cable embodiment moving the braces. The chain 112 comprises a plurality of interlocked links, in which the chain has a front link 116 and a back link 118. The front link 116 is connected to footboard 22 or brace 61 d and the remainder of chain 112 extends to back 12 of sofa 10 and then around within a portion of the side of sofa 10, as shown in FIG. 15. Motor 100 drives a sprocket, which engages the links 114 as a sprocket engages a bicycle chain. As the sprocket turns in a first direction, chain 112 moves so that front link 116 moves away from back 12 of sofa 10, which pushes footboard 22 and braces 61*a*, 61*b*, 61*c*, and 61*d* away from back 12 of sofa 10. The motor and sprocket are preferably of sufficient size to push footboard 22 to the sleeping position. It is also contemplated using a track through which the chain moves so that the chain does not bow, crimp, or move in a direction that is not parallel to the floor when pushing footboard 22. The motor also rotates in a second direction to move footboard 22 to the seating position by chain 112 pulling on footboard 22 toward back 12 of sofa 10.

Similar to the cable design, a limit switch can be used with the chain embodiment to stop the motor and movement of chain 112 when braces 61*a*, 61*b*, 61*c*, and 61*d* reach the sleeping position. For reliability and handling the load, two motors and two chains can be used in which one set is disposed on each side of sofa 10.

G. Conversion of Conventional Sleeper Sofas

The applicants' invention also encompasses systems for converting conventional mattresses and sleeper sofas to more comfortable sleeping surfaces.

1. The Retro

Figure 17:
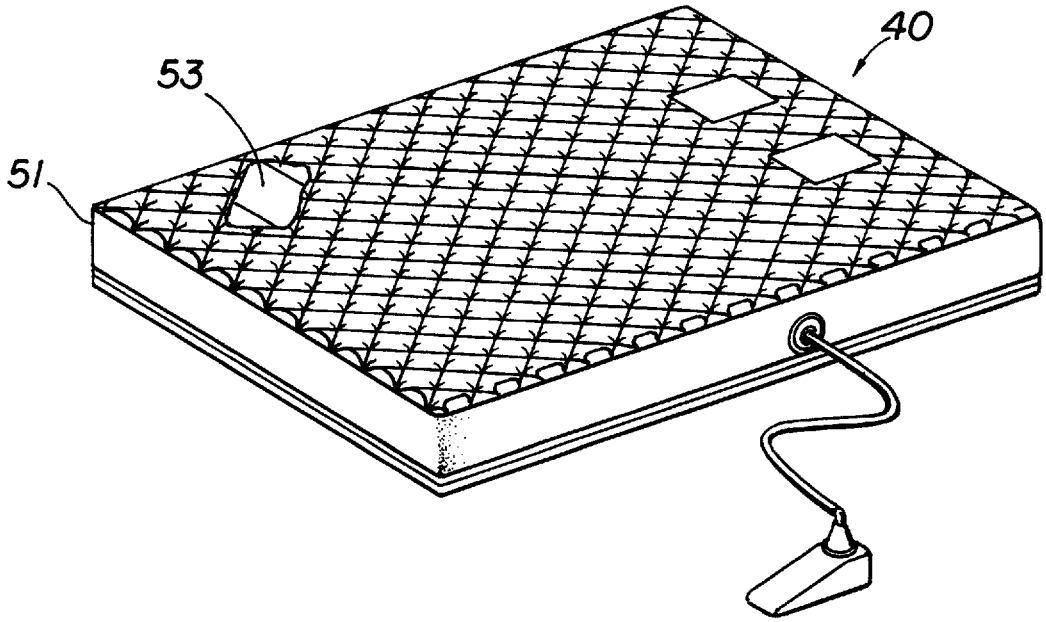
FIG. 17 is a perspective view of a first embodiment of an air mattress with a single-piece foam support adapted to supplement a spring mattress in a conventional sleeper sofa with an air-filled sleeping surface.

The first conversion system is the retro-fit system, which adapts conventional sleeper sofas to receive and support an air mattress. FIG. 17 illustrates one embodiment of the "retro," which includes a mattress cover 51 for a conventional sleeper sofa mattress using a skirt or sleeve to hold the conventional mattress and position an air chamber 53 within cover 51 above the conventional mattress. One version of this embodiment uses two sleeves, one stacked on top of the other, into which the conventional sofa mattress and air chamber are inserted. The conventional mattress is placed in the lower sleeve and the air chamber 53 is inserted in the upper sleeve. Thus, the user of a conventional sleeper sofa can enjoy the increased comfort of sleeping on an air mattress. In fact, the person using the retro cannot feel the wire mesh and the longitudinally extending hinge bar through the air chamber and conventional mattress. Nor does the retro expose the air chamber to potential damage from the wire mesh in a conventional sleeper sofa because the mattress is disposed between the mesh and chamber 53.

Figure 18:
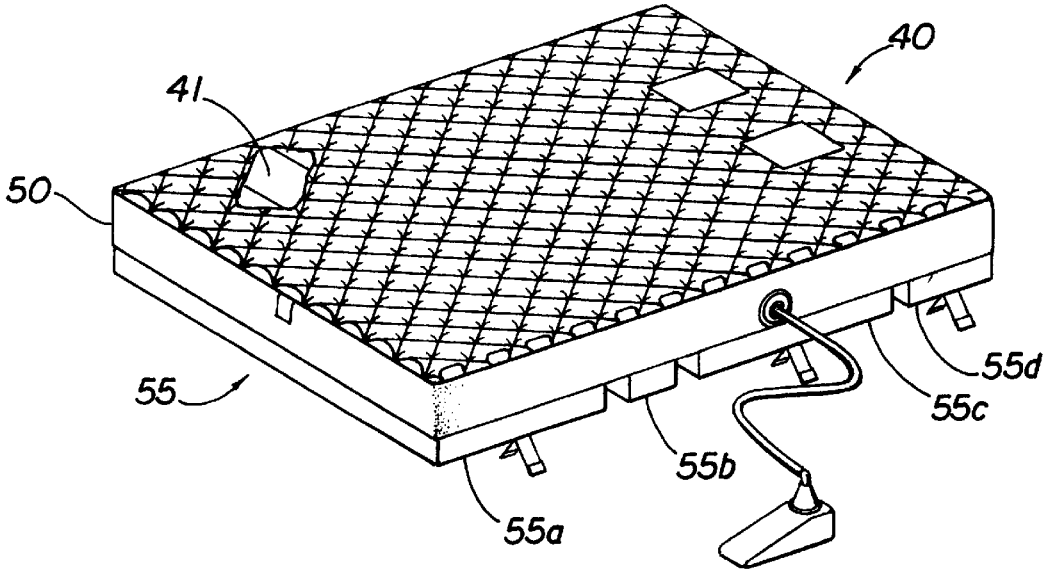
FIG. 18 is a perspective view of a second embodiment of an air mattress with a multi-piece foam support adapted to replace a conventional spring-mattress in a conventional sleeper sofa.

FIG. 18 is an illustration of another embodiment of the retro, an air mattress specifically designed to be used with a conventional sleeper sofa frame. This embodiment uses an air mattress 40 having a mattress body 41 and a cover 51 that includes support material 55 disposed between mattress body 41 and the surface of the conventional wire mesh frame. Support material 55 is connected the cover 51 of mattress 40 and placed between mattress body 41 and the conventional sleeper sofa frame.

Figure 19:
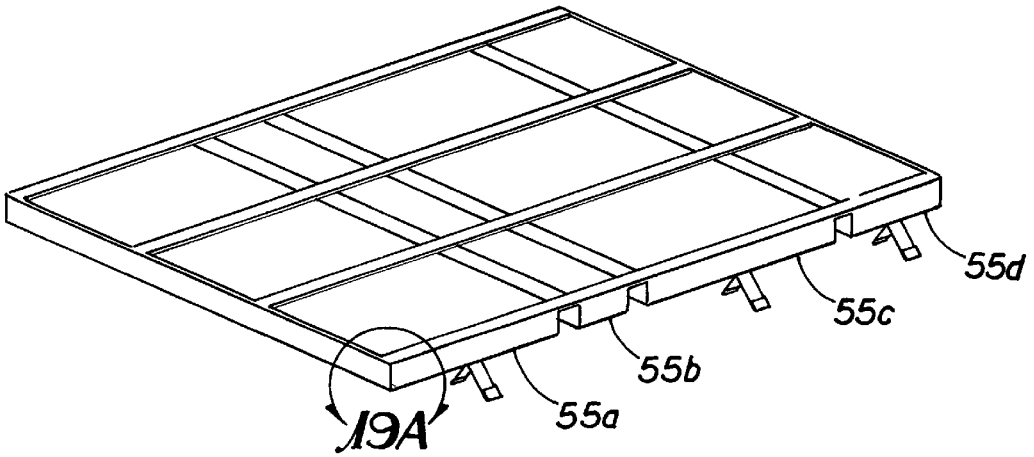
FIG. 19 is a perspective view of the multi-piece foam support system of the mattress shown in FIG. 18.
Figure 19A:
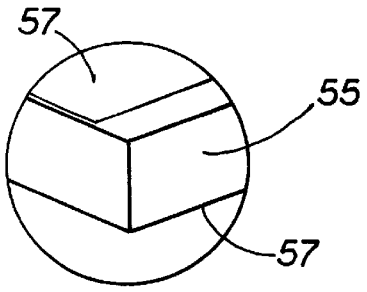
FIG. 19A is a detailed perspective view of a portion of the panel supports shown in FIG. 19 depicting a foam inner core sandwiched between solid supports.

Support material 55 has a sufficient firmness to prevent mattress body 41 from contacting the wire mesh and being damaged. Support material 55 must also be flexible to be folded and disposed within the conventional frame of the sleeper sofa when in the seating position. To increase the flexibility of support material 55, it may be subdivided into individual panels 55*a*, 55*b*, 55*c*, and 55*d*, for example, that are sized so that mattress body 41 can fold along the breaks between panels 55*a*, 55*b*, 55*c*, and 55*d*. To protect the integrity of support material 55, it may be covered on both sides with a thin layer 57 of a more rigid substrate such as polymer or wood as shown in FIG. 19A. Foam is an acceptable material for support material 55. Thus, in contrast to the first embodiment, this retro embodiment does not use the conventional mattress because support material 55 protects mattress body 41, which is the primary function of the conventional mattress in the first retro embodiment. Because this embodiment of the retro does not rely on the conventional mattress, its dimensions can be changed (e.g., increased eight inches in length) so that queen-size sheets can be used with it.

The cover 51 and mattress body 41 used with either embodiment of the retro can be stored in a separate location, either inflated or deflated, or deflated and folded into the sleeper sofa.

2. Inflatable Mattress Cover for a Conventional Mattress

Figure 20:
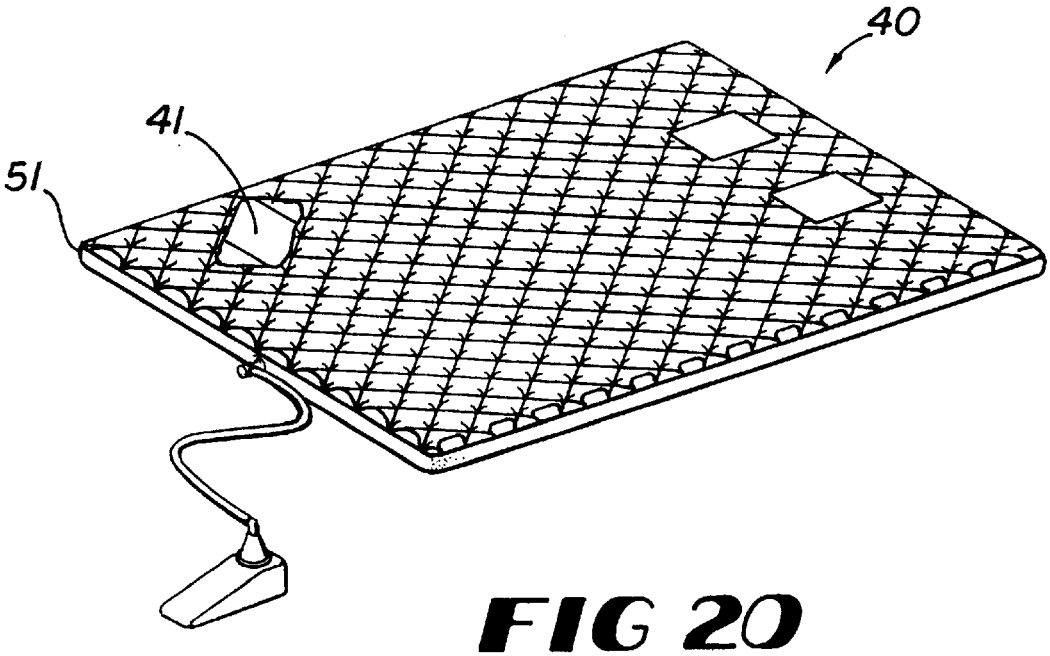
FIG. 20 is a perspective view of a third embodiment of an air mattress adapted to sit atop a conventional spring-mattress in a conventional sleeper sofa.

Another aspect of the applicants' invention is a thin inflatable mattress cover for a conventional box spring and mattress, which is illustrated in FIG. 20. The mattress 40 includes a thin mattress body 41 within cover 51 with a plurality of straps for connecting mattress 40 to a conventional mattress. Mattress 40 is sized to complementarily fit over the conventional mattress, i.e., the dimensions of a king size mattress, queen size mattress, etc. The straps wrap under the bottom of the conventional mattress to hold the mattress 40 on the top to provide the sleeping surface. The person using mattress 40, accordingly, is sleeping on the air surface and does not experience the box springs in the conventional mattress. Thus, despite the state of disrepair or discomfort of the conventional mattress, mattress 40 makes it comfortable. As one skilled in the art will also appreciate, mattress 40 can extend the life and comfort of the conventional mattress years beyond the normal useful life. Mattress 40, accordingly, revitalizes the old mattress into a comfortable sleeping surface, whatever the condition of its mattress springs.

Another aspect of this invention is using two different materials on each of the two opposed sleeping surfaces of cover 51. One side can be exposed and slept on during warm periods of the year and the other side for colder times. For example, one side of cover 51 uses cotton or silk for the warmer nights and the opposed side uses flannel or wool. Additionally, all embodiments of mattress body 41 described above in part IV.C of this document may be used in any of the embodiments of the retro described above.

3. Drop-In Sleeper Assembly for Sofa Manufacturer Use

Figure 24:
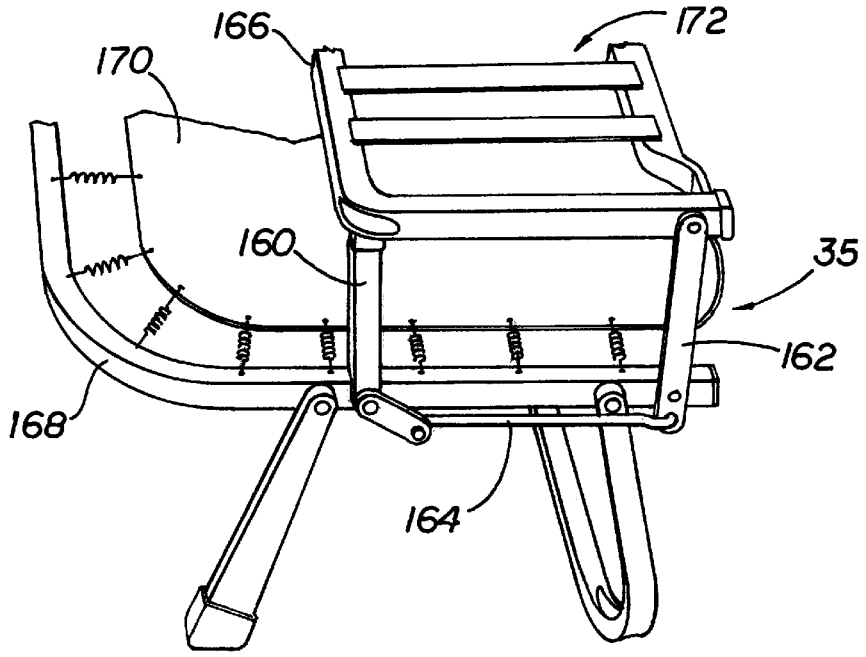
FIG. 24 is a partial perspective view of the lateral side of a conventional mattress support assembly that has been modified to accept an air mattress.

Still another aspect of the applicants' invention is a sleeper assembly 35 that allows sleeper sofa manufacturers to use the applicants' invention. Referring now to FIG. 24, the sleeper assembly 35 is shown, which is of the appropriate dimensions to be complementarily received within the body of a sleeper sofa. The illustrated sleeper assembly 35 uses the four-panel version of the folded-support embodiment as the mattress support subassembly. Of course, other versions of the mattress support subassembly discussed above can be used, if desired.

Sleeper assembly 35 adapted for use with a conventional sleeper sofa is a conventional sleeper assembly, with a wire mesh or trampoline (shown as 170) support structure that is modified to accept an air mattress. Support leg 160 and actuation rod 164 are added to the conventional frame to prevent frame 166 from collapsing onto frame 168 when sleeper assembly is in the seating position. When sleeper assembly 35 is moved to the sleeping position, the bottom of support leg 160 is pushed by actuation rod 164 as hinge member 162 rotates to become coplanar with frame 168 so that support leg 160 collapses to become substantially coplanar with frame 168. The conventional sleeper sofa is also modified by replacing the wire mesh or trampoline in frame 166 with straps 172.

The sleeper assembly 35 can be shipped to manufactures of conventional sleeper sofas and installed as a unit into the sleeper sofa during the manufacturing process. The sleeper assembly 35 allows a sofa manufacturer to use the applicants' invention without requiring that the manufacturer develop its own production line for constructing sleeper assembly 35.

Other embodiments of the invention will be apparent to those skilled in the art from their consideration of the specification and practice of the invention disclosed in this document. The applicants intend that the specification and examples be considered as exemplary only not be regarded as limitations upon the scope of the invention, with the true scope and spirit of the invention being indicated by the following claims.

What is claimed is:

1. A mattress, comprising:

A. a first chamber defined by a first top surface, a first bottom surface, and a first sidewall connecting the first top surface and the first bottom surface such that the first chamber defines a first interior;

B. a first portal in fluid communication with the first chamber that is movable between an open position to allow fluid to move into or out of the first chamber and a closed position to make the first chamber substantially pressure-tight;

C. a baffle having a plurality of apertures therethrough connected to the first chamber within the first interior and extending between the first top surface and the first bottom surface;

D. a second chamber that is:

i. defined by a second top surface, a second bottom surface, and a second sidewall connecting the second top surface and the second bottom surface, ii. connected to at least a portion of the first sidewall, and iii. positioned adjacent at least two opposing portions of the first sidewall; and E. a second portal in fluid communication with the second chamber that is movable between an open position to allow fluid to move into or out of the second chamber and a closed position to make the second chamber substantially pressure-tight; in which a first fluid pressure in the first chamber may be controlled independently of a second fluid pressure in the second chamber.

2. The mattress of claim 1, in which:

A. the baffle defines a top edge and a bottom edge and

B. the baffle is connected to:

i. the first top surface along at least a portion of the top edge of the baffle and ii. the first bottom surface along at least a portion of the bottom edge of the baffle.

3. The mattress of claim 2, in which the baffle further defines a pair of lateral edges and the baffle is connected to the first sidewall along at least a portion of each of the pair of lateral edges of the baffle.

4. The mattress of claim 1, further comprising:

A. a first fastener on the first sidewall and

B. a complementary second fastener on the second sidewall in which the second chamber is removably attached to the first chamber via the first and second fasteners.

5. The mattress of claim 4, in which the first fastener and second fastener are complementary hook-and-loop fasteners.

6. The mattress of claim 1, further comprising a mattress cover made of a material that resists substantial stretching in a plane defined by the material and having a top, an opposite bottom and upright sides interconnecting the top and bottom, the top, bottom and sides defining a cavity, and wherein the first chamber and the second chamber are substantially positioned within the cavity.

7. The mattress of claim 6, in which the mattress cover further comprises a continuous, elastomeric strap connected to the interior surfaces of the sides of the cover such that the strap is stretched when the mattress is inflated.

8. A mattress, comprising:

A. a first chamber defined by a first top surface, a first bottom surface, and a first sidewall connecting the first top surface and the first bottom surface;

B. a first portal in fluid communication with the first chamber that is movable between an open position to allow fluid to move into or out of the first chamber and a closed position to make the first chamber substantially pressure-tight;

C. a second chamber that is:

i. defined by a second top surface, a second bottom surface, and a second sidewall connecting the second top surface and the second bottom surface, ii. connected to at least a portion of the first sidewall, and iii. positioned adjacent at least two opposing portions of the first sidewall;

D. a second portal in fluid communication with the second chamber that is movable between an open position to allow fluid to move into or out of the second chamber and a closed position to make the second chamber substantially pressure-tight;

E. in which:

i. the second top surface defines a top inner edge;

ii. the second bottom surface defines a bottom inner edge;

iii. the second top surface is fixedly attached to the first chamber along substantially the entire length of the top inner edge;

iv. the second bottom surface is fixedly attached to the first chamber along substantially the entire length of the bottom inner edge; and v. a first fluid pressure in the first chamber may be controlled independently of a second fluid pressure in the second chamber.

9. The mattress of claim 8, in which at least part of the second sidewall and at least part of the first sidewall are integrally formed.

10. A mattress, comprising:

A. a chamber, comprising:

i. a top surface with a pair of top lateral roll-off prevention portions located along opposing lateral edges of the top surface, ii. a bottom surface with a pair of bottom lateral roll-off prevention portions located along opposing lateral edges of the bottom surface, and iii. a sidewall that is connected to the top surface and the bottom surface around the periphery of the top and bottom surfaces and comprises:

a. a pair of opposing lateral sidewall portions, b. a head sidewall portion spanning the pair of lateral sidewall portions, and c. a foot sidewall portion spanning the pair of lateral sidewall portions and opposite the head sidewall portion;

B. a portal in fluid communication with the chamber that is movable between an open position to allow fluid to move into or out of the chamber and a closed position to make the chamber substantially pressure-tight;

C. a baffle defining a baffle plane that is substantially perpendicular to the pair of lateral sidewall portions comprising:

i. a top edge connected to the top surface but not connected to the pair of top lateral roll-off prevention portions, ii. a bottom edge connected to the bottom surface but not connected to the pair of bottom lateral roll-off prevention portions, iii. a first lateral edge, and iv. a second lateral edge such that, when the chamber is inflated, top lateral roll-off prevention portion protrudes above the top surface and the bottom lateral roll-off prevention portion protrudes below the bottom surface.

11. The mattress of claim 10, in which the baffle includes a plurality of apertures therethrough.

12. The mattress of claim 10, in which the top edge of the baffle is connected to the top surface along substantially the entire length of the top edge of the baffle and the bottom edge of the baffle is connected to the bottom surface along substantially the entire length of the bottom edge of the baffle.

13. The mattress of claim 10 in which the shortest distance between the first lateral edge of the baffle and the second lateral edge of the baffle is smaller than the length of the top edge of the baffle and the bottom edge of the baffle.

14. The mattress of claim 13, in which the top edge of the baffle is connected to the top surface along substantially the entire length of the top edge of the baffle and the bottom edge of the baffle is connected to the bottom surface along substantially the entire length of the bottom edge of the baffle.

15. The mattress of claim 14, in which the baffle includes a plurality of apertures therethrough.

* * * * *